US006148793A

United States Patent [19]

Faletti et al.

[11] Patent Number: 6,148,793

[45] **Date of Patent: *Nov. 21, 2000**

[54] ENGINE COMPRESSION BRAKING APPARATUS UTILIZING A VARIABLE GEOMETRY TURBOCHARGER

[75] Inventors: James J. Faletti, Spring Valley; Dennis D. Feucht; Scott G. Sinn, both of Morton, all of Ill.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/070,986

[22] Filed: May 1, 1998

Related U.S. Application Data

[60] Division of application No. 08/573,162, Dec. 15, 1995, Pat. No. 5,813,231, which is a continuation-in-part of application No. 08/468,937, Jun. 6, 1995, Pat. No. 5,540,201, which is a continuation of application No. 08/282,573, Jul. 29, 1994, abandoned.

[51] Int. Cl.[7] ..... F02D 13/04

[52] U.S. Cl. ..... 123/322

[58] Field of Search ..... 123/321, 322, 123/323; 60/602

[56] References Cited

U.S. PATENT DOCUMENTS

| | | | |
|---|---|---|---|
| 3,220,392 | 11/1965 | Cummins | 123/321 |
| 4,395,884 | 8/1983 | Price | 60/602 |
| 4,474,006 | 10/1984 | Price et al. | 60/602 |
| 4,572,114 | 2/1986 | Sickler | 123/21 |
| 4,688,384 | 8/1987 | Pearman et al. | 60/600 |
| 4,932,372 | 6/1990 | Meneely | 123/182 |
| 5,012,778 | 5/1991 | Pitzi | 123/321 |
| 5,119,633 | 6/1992 | Brooks et al. | 60/624 |
| 5,121,723 | 6/1992 | Stepper et al. | 123/322 |
| 5,123,246 | 6/1992 | Younessi et al. | 60/602 |
| 5,255,650 | 10/1993 | Faletti et al. | 123/322 |
| 5,335,636 | 8/1994 | Bilei et al. | 123/321 |
| 5,410,882 | 5/1995 | Davies et al. | 60/602 |
| 5,437,156 | 8/1995 | Custer | 60/611 |
| 5,444,980 | 8/1995 | Dellora et al. | 60/602 |
| 5,647,318 | 7/1997 | Feucht et al. | 123/321 |

FOREIGN PATENT DOCUMENTS 2820941 11/1978 Germany .

OTHER PUBLICATIONS

Edward F. Obert, *Internal Combustion Engines and Air Pollution*, Harper & Row (1973), p. 695 (Fig. 17–10).

*Primary Examiner*—Tony M. Argenbright
*Attorney, Agent, or Firm*—Marshall O'Toole Gerstein Murray & Borun

[57] ABSTRACT

A braking control for an engine permits the timing and duration of exhaust valve opening events to be accurately determined independent of engine events so that braking power can be precisely controlled. According to one embodiment, further control over braking power can be accomplished by controlling turbocharger geometry.

5 Claims, 17 Drawing Sheets

FIG. 5A
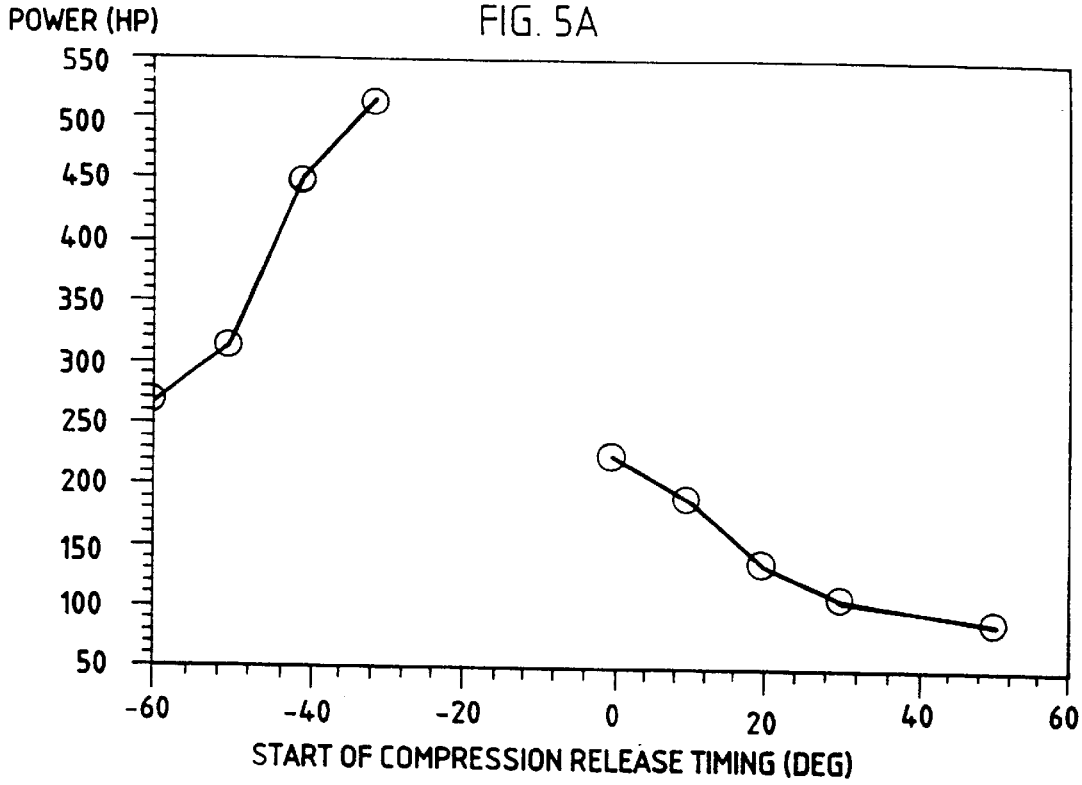
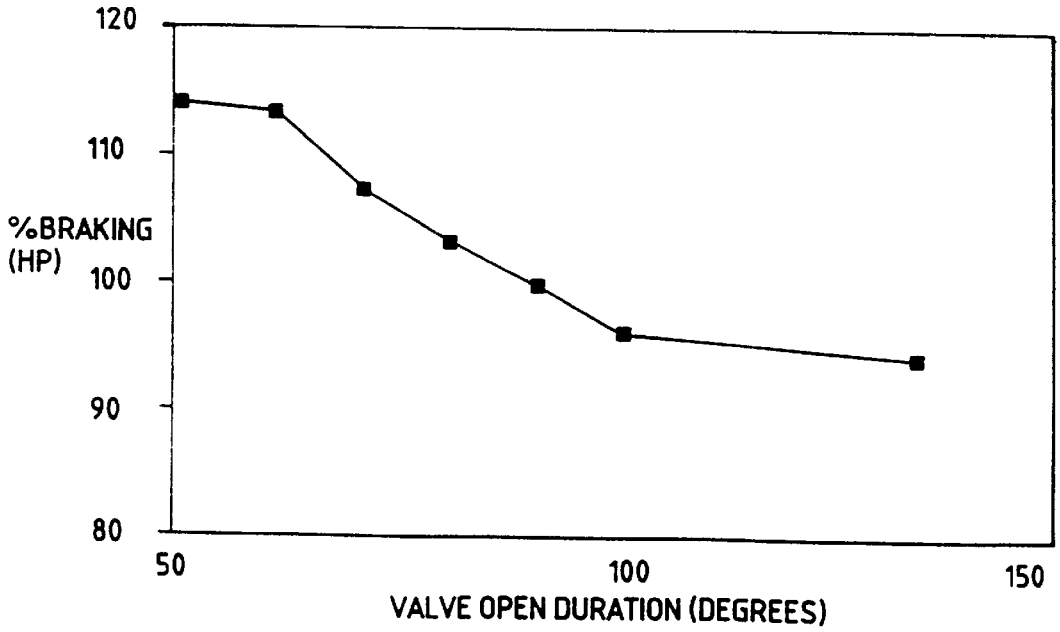
FIG. 5B

CLUTCH SW
383a
THROTTLE POSITION
383b
ENGINE SPEED
383c
SERVICE BRK SW
383d
CRUISE ON/OFF SW
383e
BRK ON/OFF SW
383f
SELECT SWITCH
383
330
BRAKING ?
345
72
384
OTHER INPUTS
INJECTOR CONTROL MODULE
TO LINES 340a-340f
NO
YES
340g
340h
342
HIGH WINS
361
344
340a
340b
340c
340d
340e
340f
340i
340j
341
TO DRIVERS 302a-302f AND CURRENT CONTROL CIRCUITS 308-310 AND SOL. DRV. 312
334
346
348
360
CYL. SEL.
350
d/dt
352
332
356
358
354
338
336
MAP
370
DEG. ON
DEG. OFF
368
BOOST CONTROL MODULE
FROM BLOCK 345
362
365
364
63
TURBOCHARGER
366

ENGINE COMPRESSION BRAKING APPARATUS UTILIZING A VARIABLE GEOMETRY TURBOCHARGER

This is a divisional of U.S. application Ser. No. 08/573,162, filed Dec. 15, 1995, now U.S. Pat. No. 5,813,231, which is a continuation-in-part of application Ser. No. 08/468,937, filed on Jun. 6, 1995, now U.S. Pat. No. 5,540,201, that is in turn a continuation of application Ser. No. 08/282,573 filed on Jul. 29, 1994, abandoned.

TECHNICAL FIELD

The present invention relates generally to engine retarding systems and methods and, more particularly, to an apparatus and method for engine compression braking using electronically controlled hydraulic actuation.

BACKGROUND ART

Engine brakes or retarders are used to assist and supplement wheel brakes in slowing heavy vehicles, such as tractor-trailers. Engine brakes are desirable because they help alleviate wheel brake overheating. As vehicle design and technology have advanced, the hauling capacity of tractor-trailers has increased, while at the same time rolling resistance and wind resistance have decreased. Thus, there is a need for advanced engine braking systems in today's heavy vehicles.

Problems with existing engine braking systems include high noise levels and a lack of smooth operation at some braking levels resulting from the use of less than all of the engine cylinders in a compression braking scheme. Also, existing systems are not readily adaptable to differing road and vehicle conditions. Still further, existing systems are complex and expensive.

Known engine compression brakes convert an internal combustion engine from a power generating unit into a power consuming air compressor.

U.S. Pat. No. 3,220,392 issued to Cummins on Nov. 30, 1965, discloses an engine braking system in which an exhaust valve located in a cylinder is opened when the piston in the cylinder nears the top dead center (TDC) position on the compression stroke. An actuator includes a master piston, driven by a cam and pushrod, which in turn drives a slave piston to open the exhaust valve during engine braking. The braking that can be accomplished by the Cummins device is limited because the timing and duration of the opening of the exhaust valve is dictated by the geometry of the cam which drives the master piston and hence these parameters cannot be independently controlled.

In conjunction with the increasingly widespread use of electronic controls in engine systems, braking systems have been developed which are electronically controlled by a central engine control unit which optimizes the performance of the braking system.

U.S. Pat. No. 5,012,778 issued to Pitzi on May 7, 1991, discloses an engine braking system which includes a solenoid actuated servo valve hydraulically linked to an exhaust valve actuator. The exhaust valve actuator comprises a piston which, when subjected to sufficient hydraulic pressure, is driven into contact with a contact plate attached to an exhaust valve stem, thereby opening the exhaust valve. An electronic controller activates the solenoid of the servo valve. A group of switches are connected in series to the controller and the controller also receives inputs from a crankshaft position sensor and an engine speed sensor.

U.S. Pat. No. 5,255,650 issued to Faletti et al. on Oct. 26, 1993, and assigned to the assignee of the present application, discloses an electronic control system which is programmed to operate the intake valves, exhaust valves, and fuel injectors of an engine according to two predetermined logic patterns. According to a first logic pattern, the exhaust valves remain closed during each compression stroke. According to a second logic pattern, the exhaust valves are opened as the piston nears the TDC position during each compression stroke. The opening position, closing position, and the valve lift are all controlled independently of the position of the engine crankshaft.

U.S. Pat. No. 4,572,114 issued to Sickler on Feb. 25, 1986, discloses an electronically controlled engine braking system. A pushtube of the engine reciprocates a rocker arm and a master piston so that pressurized fluid is delivered and stored in a high pressure accumulator. For each engine cylinder, a three-way solenoid valve is operable by an electronic controller to selectively couple the accumulator to a slave bore having a slave piston disposed therein. The slave piston is responsive to the admittance of the pressurized fluid from the accumulator into the slave bore to move an exhaust valve crosshead and thereby open a pair of exhaust valves. The use of an electronic controller allows braking performance to be maximized independent of restraints resulting from mechanical limitations. Thus, the valve timing may be varied as a function of engine speed to optimize the retarding horsepower developed by the engine.

A number of patents disclose the use of a turbocharger with an engine operable in a braking mode. For example, Pearman et al. U.S. Pat. No. 4,688,384, Davies et al. U.S. Pat. No. 5,410,882 and Custer U.S. Pat. No. 5,437,156 disclose compression release engine braking systems wherein the intake manifold pressure of the engine is controlled so that excessive stresses in the engine and engine brake are prevented. The Pearman et al. and Custer patents disclose the use of pressure release apparatus connected directly to the intake manifold whereas the system disclosed in the Davies et al. patent retards the turbocharger in any of a number of ways, such as by restricting the flow of exhaust gas to or from the turbocharger or by controlling the exhaust gas flow to bypass the turbocharger.

Meneely U.S. Pat. No. 4,932,372 likewise discloses the use of a turbocharger with an engine operable in a braking mode. In addition to the mechanism for opening each exhaust valve of each cylinder of the engine near top dead center of each compression stroke, the Meneely apparatus includes means for increasing the pressure of gases in the exhaust manifold sufficiently to open exhaust valves of other cylinders on the intake stroke after each exhaust valve on the compression stroke is so opened. Such means comprises a device within the turbocharger for diverting the exhaust gases to a restricted portion of the turbine nozzle, thereby increasing the pressure of gases directed onto the turbine blades of the turbocharger and causing back pressure to be developed in the exhaust manifold.

In each of the foregoing systems, controllability over engine braking levels is accomplished by varying boost magnitude alone inasmuch as the timing and duration of exhaust valve opening events are preset by establishing the lash between the exhaust valve actuator and the exhaust valve accomplished by varying boost magnitude alone inasmuch as the timing and duration of exhaust valve opening events are preset by establishing the lash between the exhaust valve actuator and the exhaust valve crosshead. Accordingly, only a limited degree of variability in braking magnitude can be accomplished.

DISCLOSURE OF THE INVENTION

A brake control according to the present invention permits high braking levels to be achieved and affords a high degree of controllability over engine braking.

More particularly, a brake control for an engine having a variable geometry turbocharger which is controllable to vary intake manifold pressure and wherein the engine is operable in a braking mode includes a turbocharger geometry actuator for varying turbocharger geometry and an exhaust valve actuator for opening an exhaust valve of the engine. Means are operable while the engine is in the braking mode and responsive to a command representing a desired load condition for operating the turbocharger geometry actuator and the exhaust valve actuator.

Preferably, the operating means is implemented by an engine control module responsive to an engine condition. Also preferably, the operating means includes a look-up table responsive to engine speed and the command and developing a first signal representing commanded turbocharger geometry. The operating means may further include an additional look-up table responsive to the first signal for developing a second signal for operating the turbocharger geometry actuator. Still further, the operating means preferably includes means for providing means includes a third look-up table responsive to engine speed and the command.

In accordance with further alternative embodiments, the command comprises a braking magnitude signal or a speed magnitude signal. In the latter event, the operating means is responsive to an actual speed signal representing actual load speed and further includes a summer for developing a difference signal representing a magnitude difference between the speed magnitude signal and the actual speed signal.

In accordance with yet another alternative embodiment, the operating means includes a look-up table responsive to engine speed and the command and develops an operating signal for the exhaust valve actuator. In this embodiment, the operating means may further include a circuit which develops an additional operating signal at a constant magnitude for the turbocharger geometry actuator.

According to another aspect of the present invention, a brake control for an engine including a variable geometry turbocharger having vanes that are movable to vary engine intake manifold pressure and wherein the engine is operable in a braking mode during which each of a plurality of engine exhaust valves is opened to allow compressed gases in an associated combustion chamber to escape during a compression stroke and thereby brake a vehicle propelled by the engine includes a vane actuator for varying turbocharger geometry and a plurality of exhaust valve actuators each for opening an associated exhaust valve. An engine control is operable while the engine is in the braking mode and is responsive to a sensed engine condition and an operator command representing a desired vehicle condition for variably operating both the vane actuator and the exhaust valve actuator.

In accordance with yet another aspect of the present invention, a brake control for an engine having an intake manifold and operable in a braking mode during which an engine exhaust valve is opened to allow compressed gases in an associated combustion chamber to escape during a compression stroke and thereby brake a load driven by the engine includes means for controlling at least one of intake and exhaust manifold pressure of the engine and an exhaust valve actuator for opening the exhaust valve. Means are operable while the engine is in the braking mode and are responsive to a command representing a desired load condition for operating the controlling means and the exhaust valve actuator such that the exhaust valve is opened at a selectable timing and for a selectable duration.

Other features and advantages are inherent in the apparatus claimed and disclosed or will become apparent to those skilled in the art from the following detailed description in conjunction with the accompanying drawings.

BRIEF DESCRIPTION OF THE DRAWINGS

FIG. 5A comprises a graph illustrating braking power as a function of compression release timing of an engine;

FIG. 5B comprises a graph illustrating percent braking horsepower as a function of valve open duration;

BEST MODE FOR CARRYING OUT THE INVENTION

Figure 1:
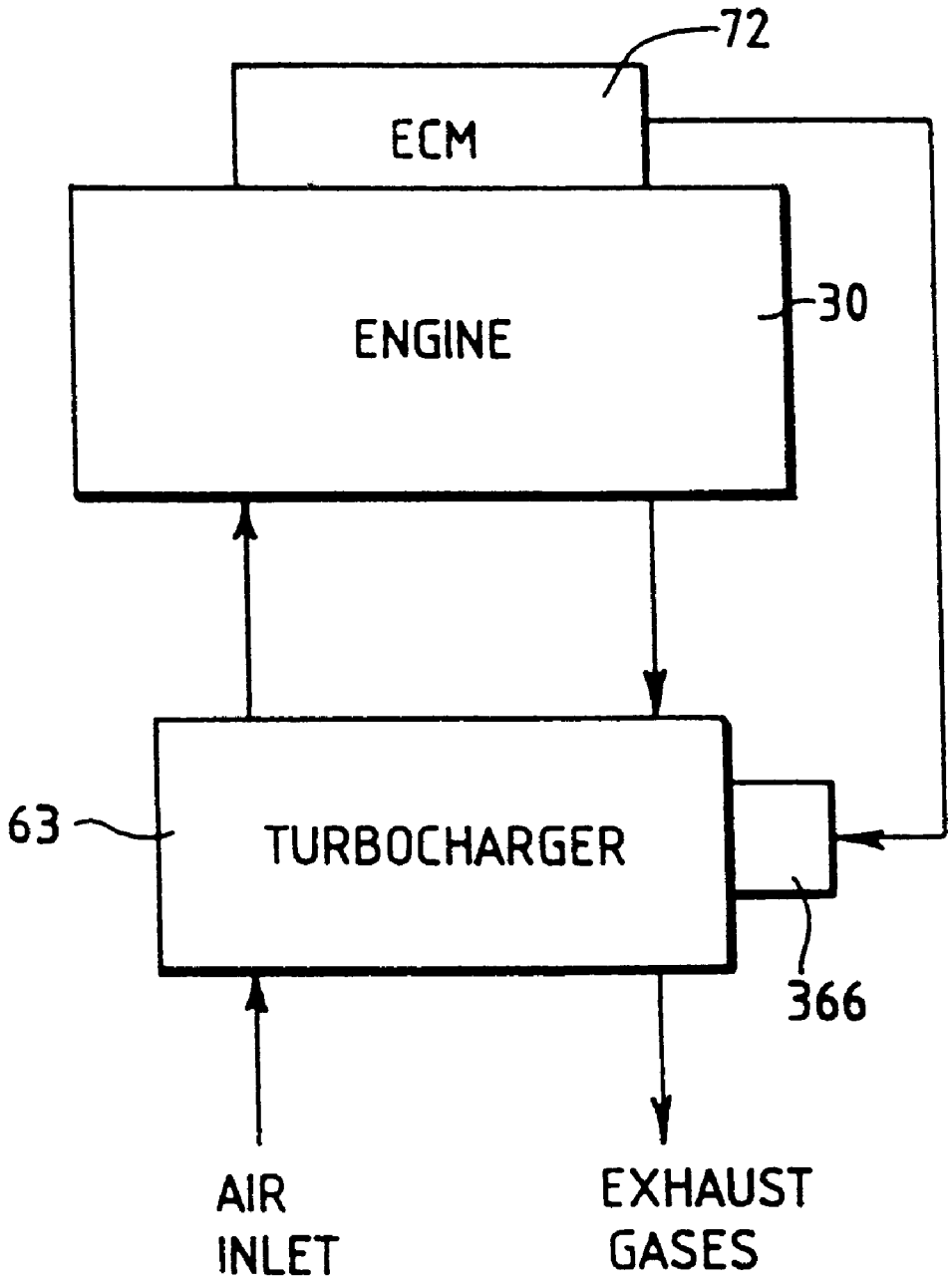
FIG. 1 is a block diagram of an internal combustion engine together with a variable geometry turbocharger and which may incorporate a braking control according to the present invention.
Figure 2:
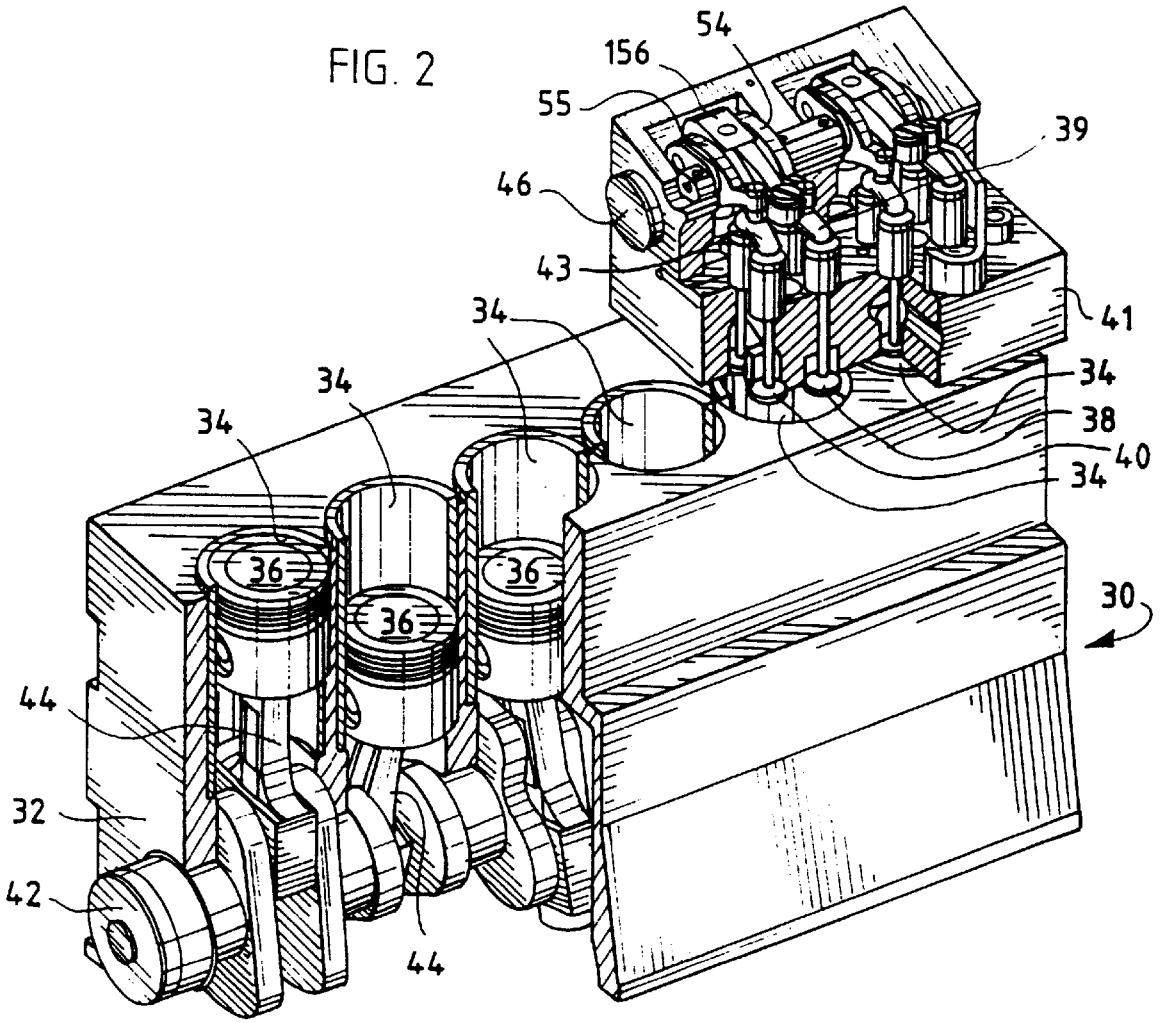
FIG. 2 is a fragmentary isometric view of the engine of FIG. 1 with portions removed to reveal detail therein.
Figure 3:
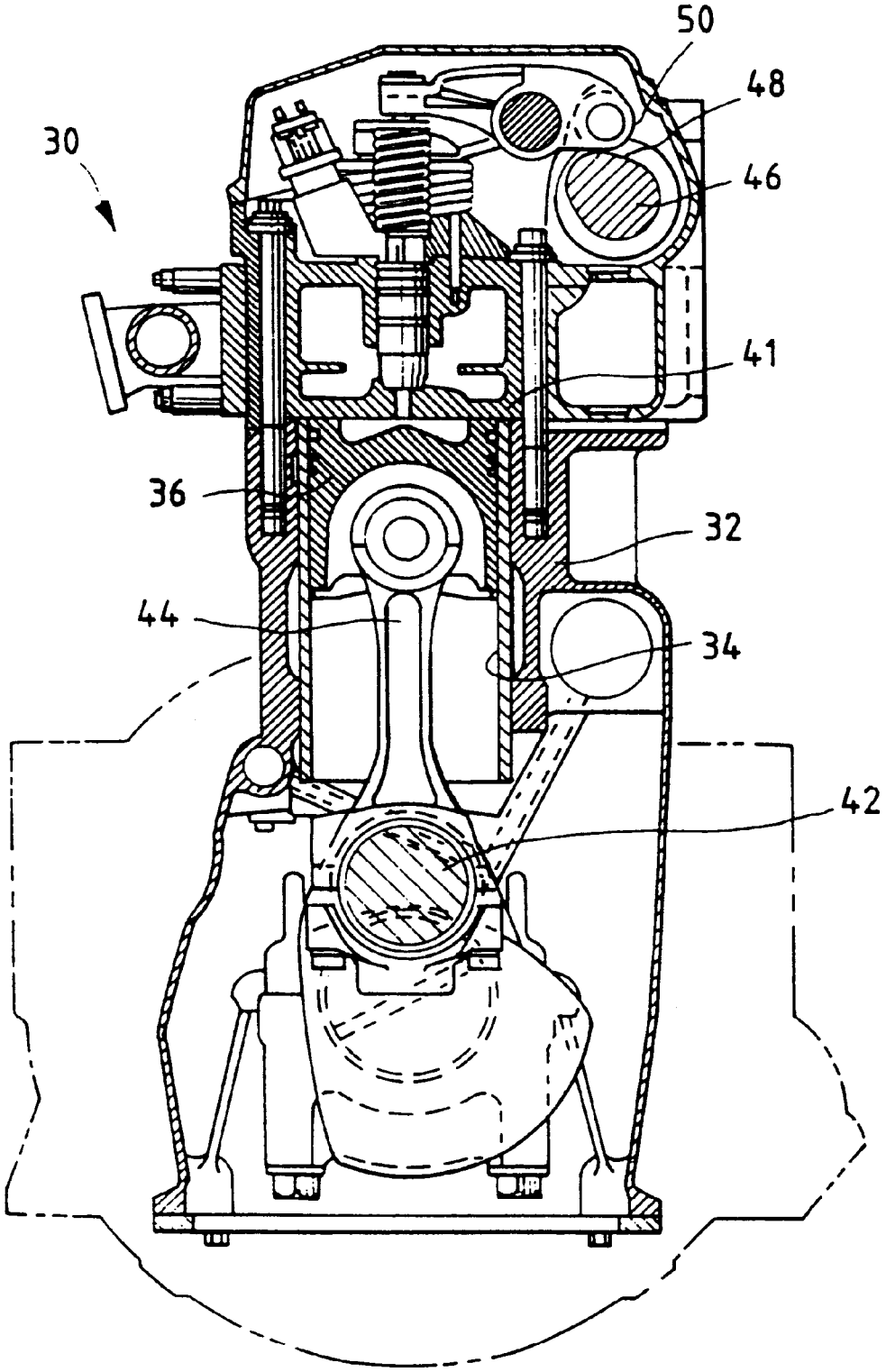
FIG. 3 comprises a sectional view of the engine of FIG. 2.

Referring now to FIGS. 1–3, an internal combustion engine 30, which may be of the four-cycle, compression ignition type, undergoes a series of engine events during operation thereof. In the preferred embodiment, the engine sequentially and repetitively undergoes intake, compression, expansion and exhaust cycles during operation. As seen in FIGS. 2 and 3, the engine 30 includes a block 32 within which is formed a plurality of combustion chambers or cylinders 34, each of which includes an associated piston 36 therein. Intake valves 38 and exhaust valves 40 are carried in a head 41 bolted to the block 32 and are operated to control the admittance and expulsion of fuel and gases into and out of each cylinder 34. A crankshaft 42 is coupled to and rotated by the pistons 36 via connecting rods 44 and a camshaft 46 is coupled to and rotates with the crankshaft 42 in synchronism therewith. The camshaft 46 includes a plurality of cam lobes 48 (one of which is visible in FIG. 3) which are contacted by cam followers 50 (FIG. 3) carried by rocker arms 54, 55 which in turn bear against intake and exhaust valves 38, 40, respectively.

In the engine 30 shown in FIGS. 2 and 3, there are a pair of intake valves 38 and a pair of exhaust valves 40 per cylinder 34 wherein the valves of each pair 38 or 40 are interconnected by a valve bridge 39 or 43, respectively. Each cylinder 34 may instead have a different number of associated intake and exhaust valves 38, 40, as necessary or desirable.

Figure 4:
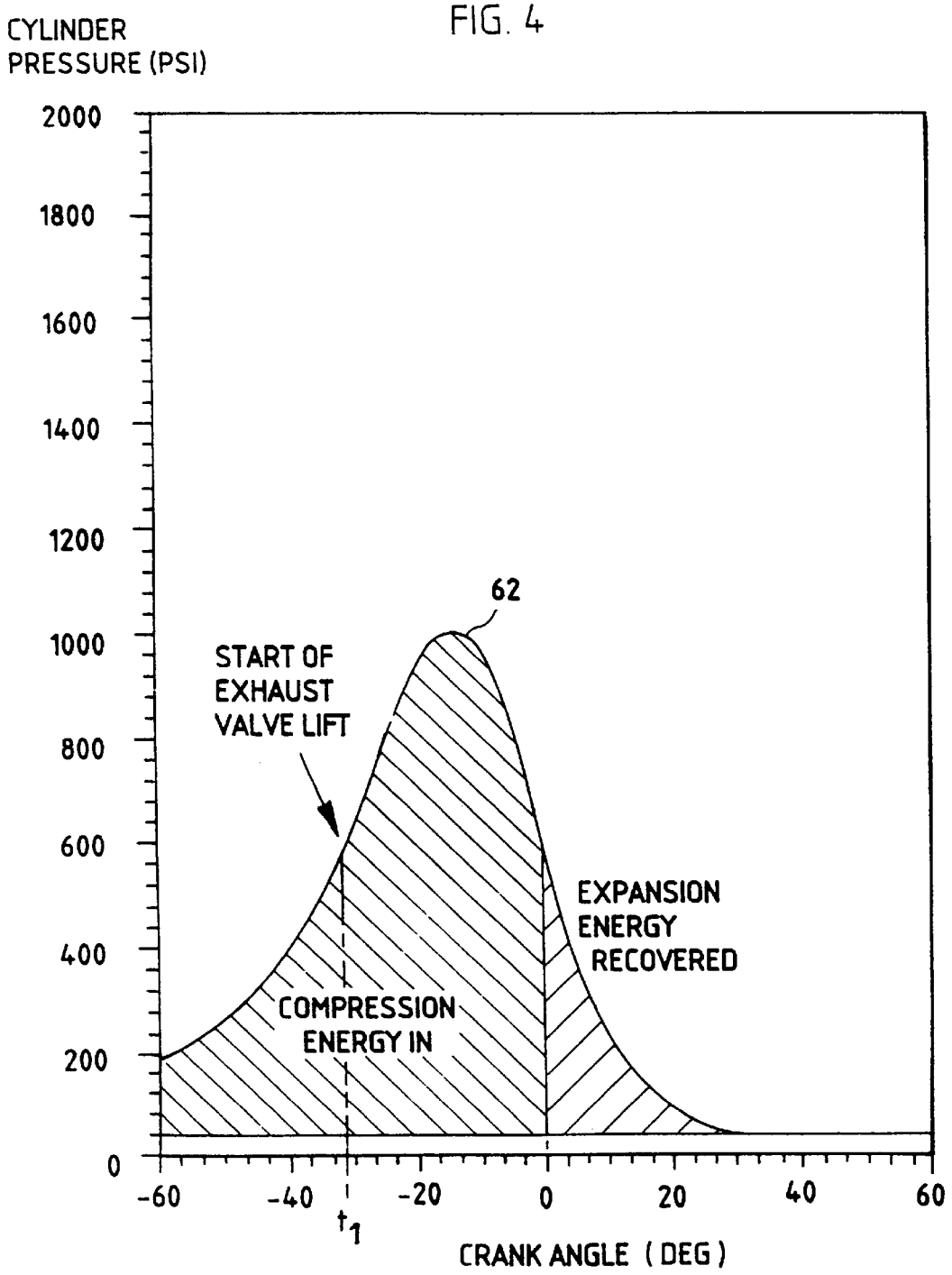
FIG. 4 comprises a graph illustrating cylinder pressure as a function of crankshaft angle in a braking mode of operation of an engine.

The graphs of FIGS. 4 and 5A illustrate cylinder pressure and braking horsepower, respectively, as a function of crankshaft angle relative to top dead center (TDC). As seen in FIG. 4, during operation in a braking mode, the exhaust valves 40 of each cylinder 34 are opened at a time $t_1$ prior to TDC so that the work expended in compressing the gases within the cylinder 34 is not recovered by the crankshaft 42. The resulting effective braking by the engine is proportional to the difference between the area under the curve 62 prior to TDC and the area under the curve 62 after TDC. This difference, and hence the effective braking, can be changed by changing the timing $t_1$ at which the exhaust valves 40 are opened during the compression stroke. This relationship is illustrated by the graph of FIG. 5A.

As seen in FIG. 5B, the duration of time the exhaust valves are maintained in an open state also has an effect upon the maximum braking horsepower which can be achieved. Still further, engine braking magnitude can also be controlled by varying engine intake and/or exhaust pressure. According to one embodiment of the present invention, this can be accomplished by controlling a turbocharger 63 (FIG. 1), as noted in greater detail hereinafter.

Figure 6:
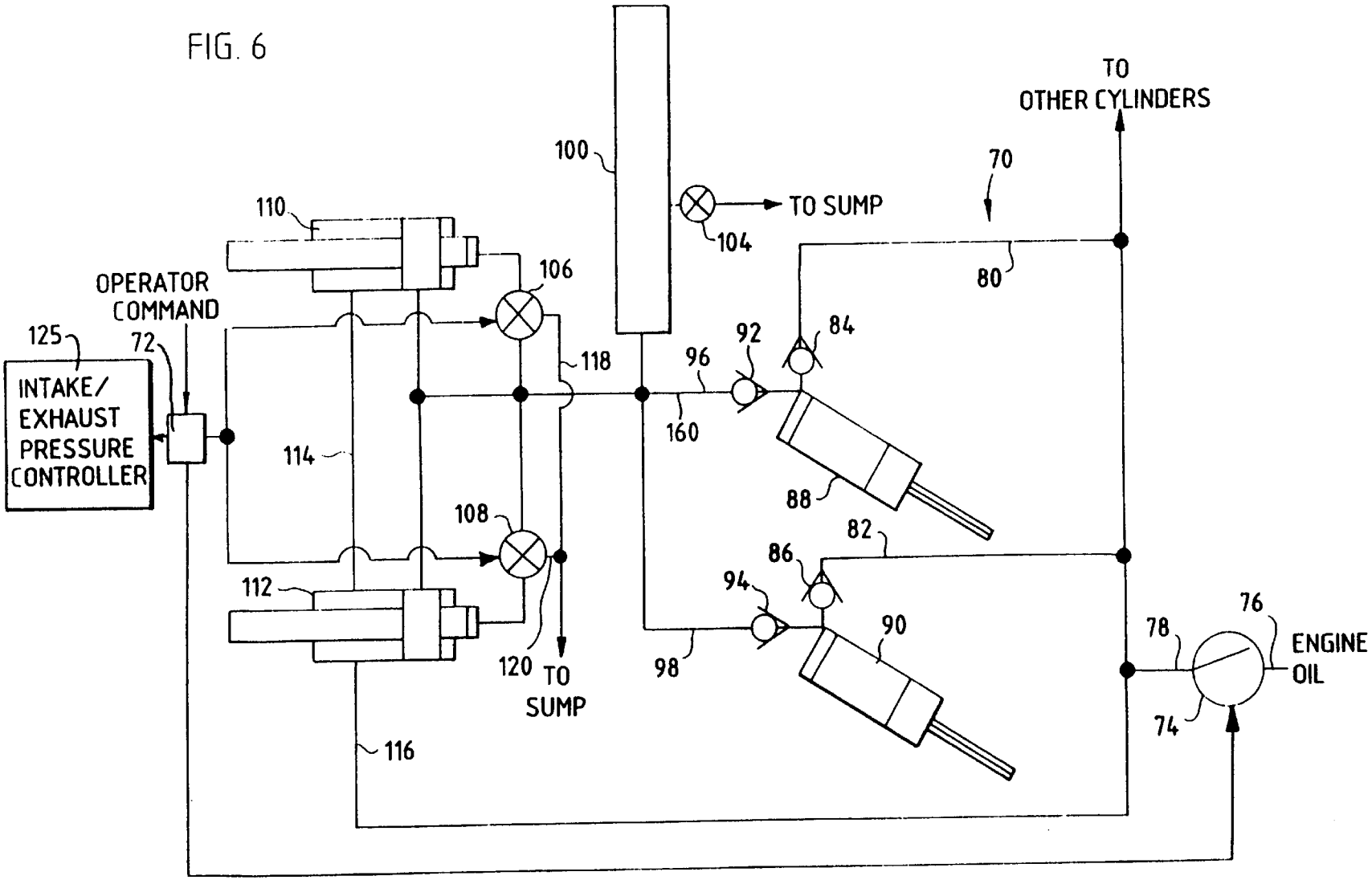
FIG. 6 comprises a combined block and schematic diagram of a braking control according to the present invention.

With reference now to FIG. 6, a two-cylinder portion 70 of a brake control according to the present invention is illustrated. The portion 70 of the brake control illustrated in FIG. 6 is operated by an electronic control module (ECM) 72 to open the exhaust valves 40 of two cylinders 34 with a selectable timing and duration of exhaust valve opening. For a six cylinder engine, up to three of the portions 70 in FIG. 6 could be connected to the ECM 72 so that engine braking is accomplished on a cylinder-by-cylinder basis. Alternatively, fewer than three portions 70 could be used and/or operated so that braking is accomplished by less than all of the cylinders and pistons. Also, it should be noted that the portion 70 can be modified to operate any other number of exhaust valves for any other number of cylinders, as desired.

The ECM 72 operates a solenoid control valve 74 to couple a conduit 76 to a conduit 78. The conduit 76 receives engine oil at supply pressure, and hence operating the solenoid control valve 74 permits engine oil to be delivered to conduits 80, 82 which are in fluid communication with check valves 84, 86, respectively. The engine oil under pressure causes pistons of a pair of reciprocating pumps 88, 90 to extend and contact drive sockets of injector rocker arms (described and shown below). The rocker arms reciprocate the pistons and cause oil to be supplied under pressure through check valves, 92, 94 and conduits 96, 98 to an accumulator 100. As such pumping is occurring, oil continuously flows through the conduits 80 and 82 to refill the pumps 88, 90.

In the preferred embodiment, the accumulator 100 does not include a movable member, such as a piston or bladder, although such a movable member could be included therein, if desired. Further, the accumulator includes a pressure control valve 104 which vents engine oil to sump when a predetermined pressure is exceeded, for example 6,000 p.s.i.

The conduit 96 and accumulator 100 are further coupled to a pair of solenoid control valves 106, 108 and a pair of servo-actuators 110, 112. The servo-actuators 110, 112 are coupled by conduits 114, 116 to the pumps 88, 90 via the check valves 84, 86, respectively. The solenoid control valves 106, 108 are further coupled by conduits 118, 120 to sump.

As noted in greater detail hereinafter, when operation in the braking mode is selected by an operator, the ECM 72 closes the solenoid control valve 74 and operates the solenoid control valves 106, 108 to cause the servo-actuators 110, 112 to contact valve bridges 43 and open associated exhaust valves 40 in associated cylinders 34 near the end of a compression stroke. It should be noted that the control of FIG. 6 may be modified such that a different number of cylinders is serviced by each accumulator. In fact, by providing an accumulator with sufficient capacity, all of the engine cylinders may be served thereby.

Also when operation in the braking mode is selected, the ECM 72 operates an intake and/or exhaust pressure controller 125 to controllably vary the pressure in the intake and/or exhaust manifolds of the engine. By controlling such pressure(s), and thus the air pressure in the engine cylinders, a high degree of controllability over engine braking magnitude can be achieved.

Figure 7:
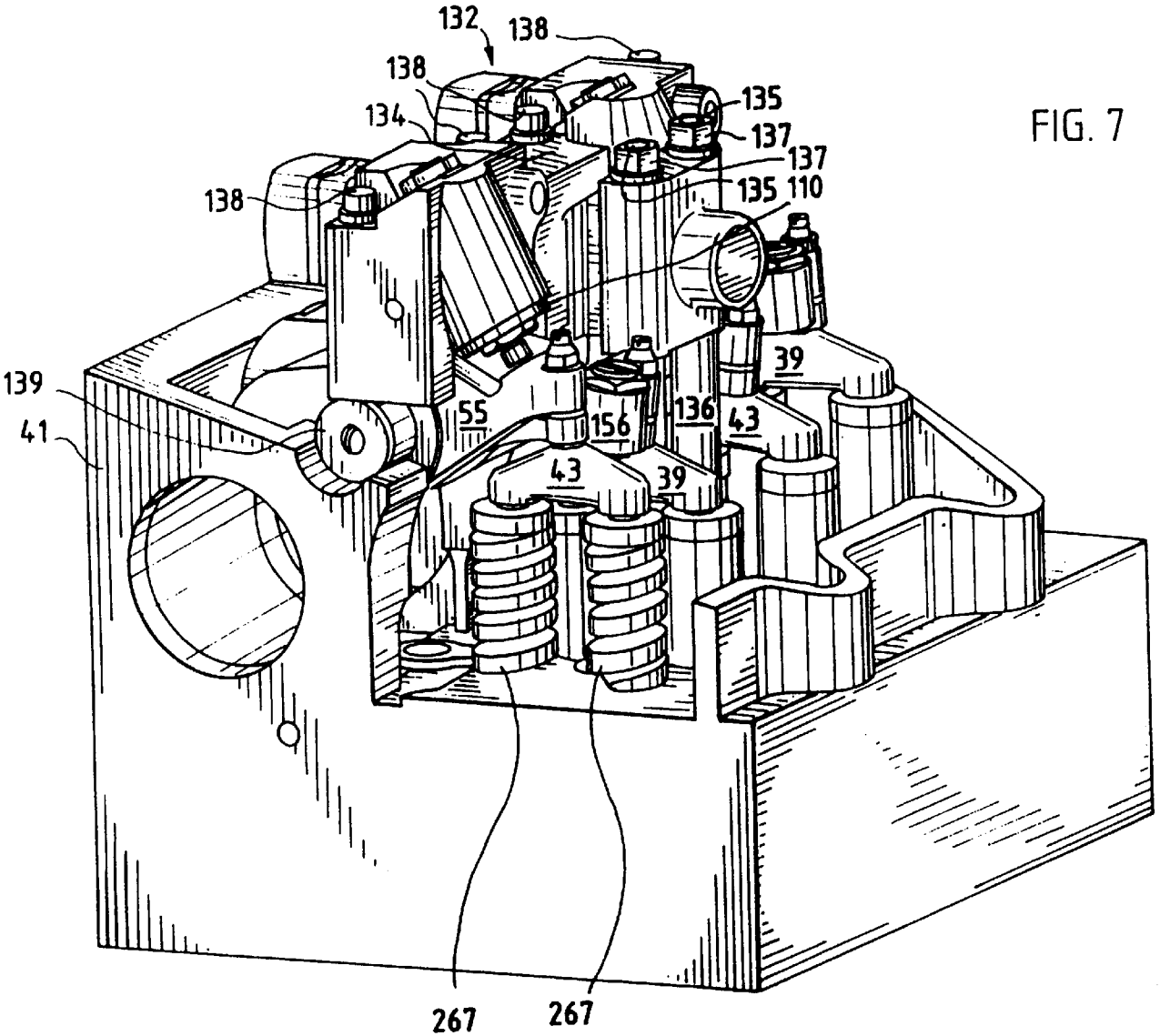
FIG. 7 comprises a perspective view of hydromechanical hardware for implementing the control of the present invention.
Figure 8:
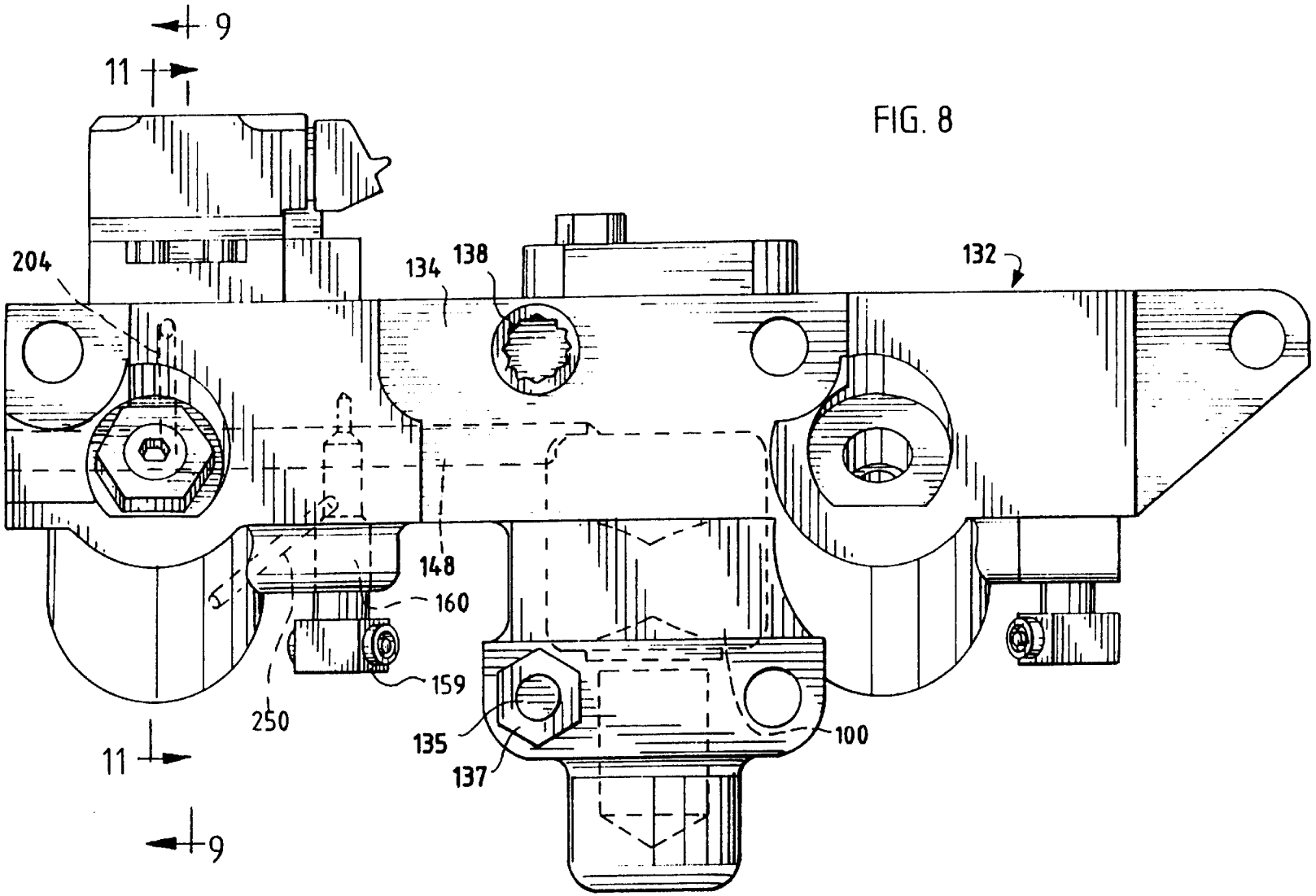
FIG. 8 comprises a plan view of the hardware of FIG. 7 with structures removed therefrom to the right of a centerline to more clearly illustrate the design thereof.
Figure 9:
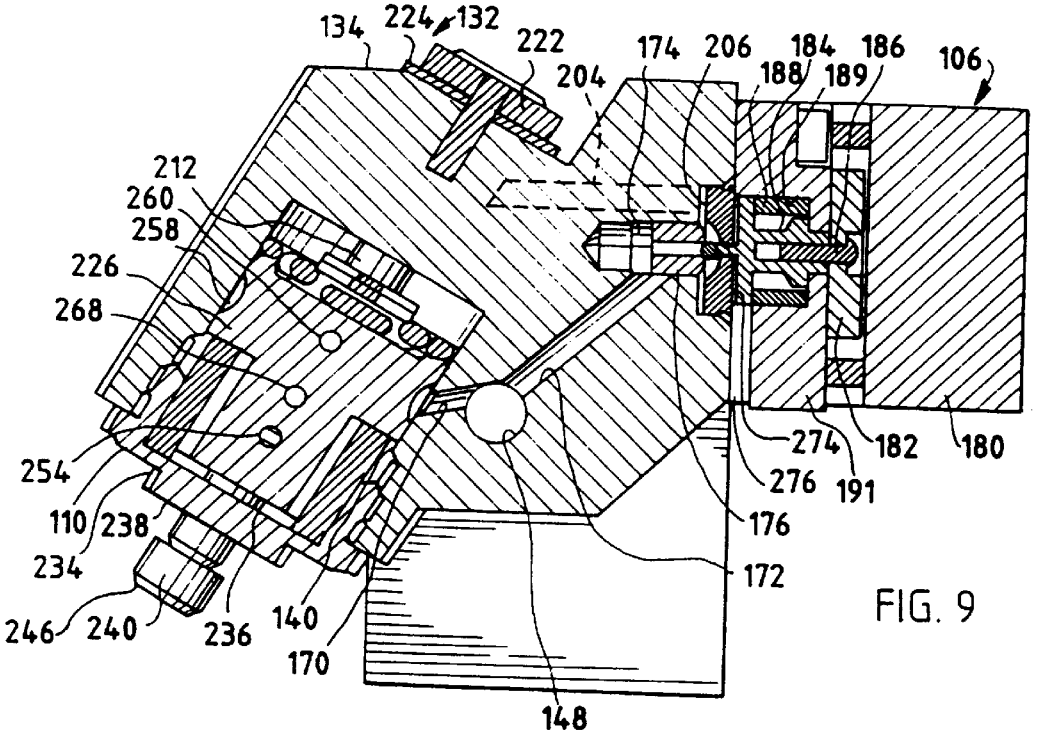
FIGS. 9 and 11 are sectional views taken generally along the lines 9—9 and 11—11, respectively, of FIG. 8.
Figure 10:
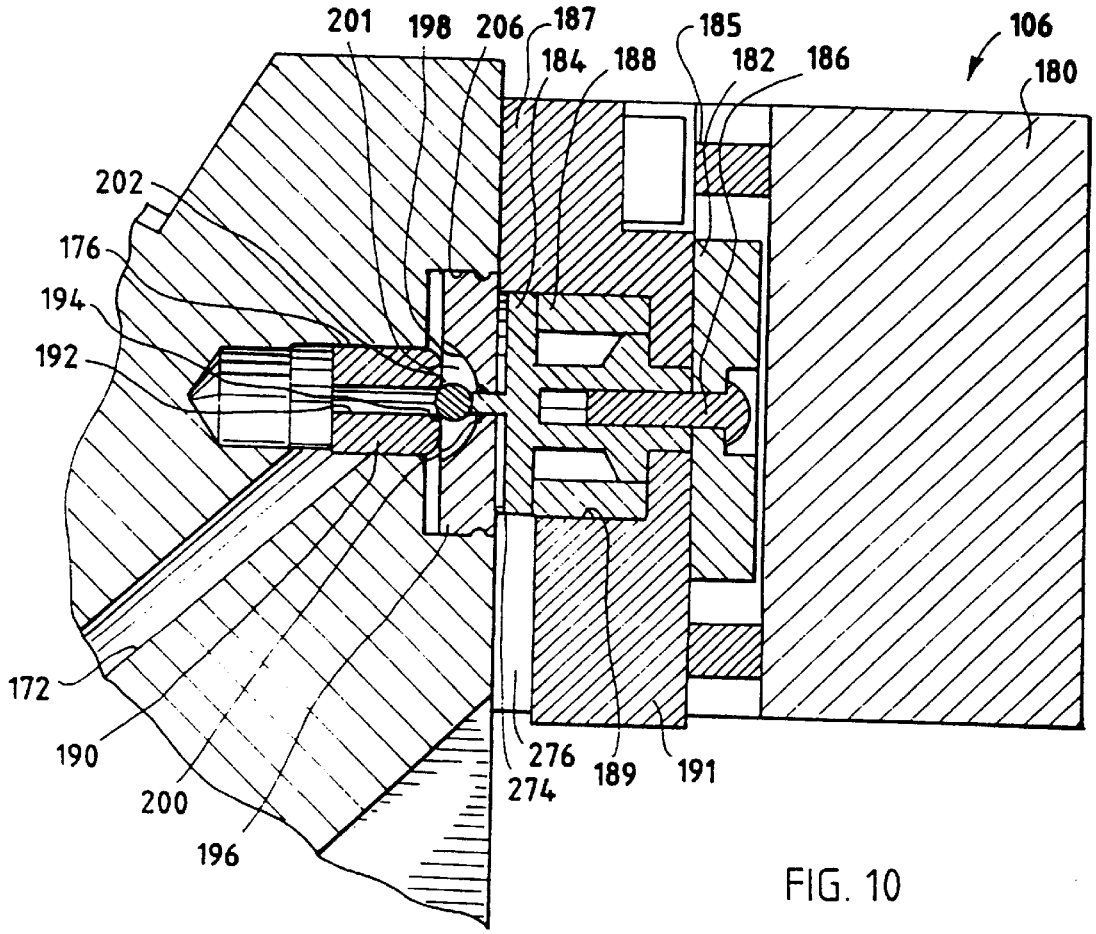
FIG. 10 is an enlarged fragmentary view of a portion of FIG. 9.
Figure 11:
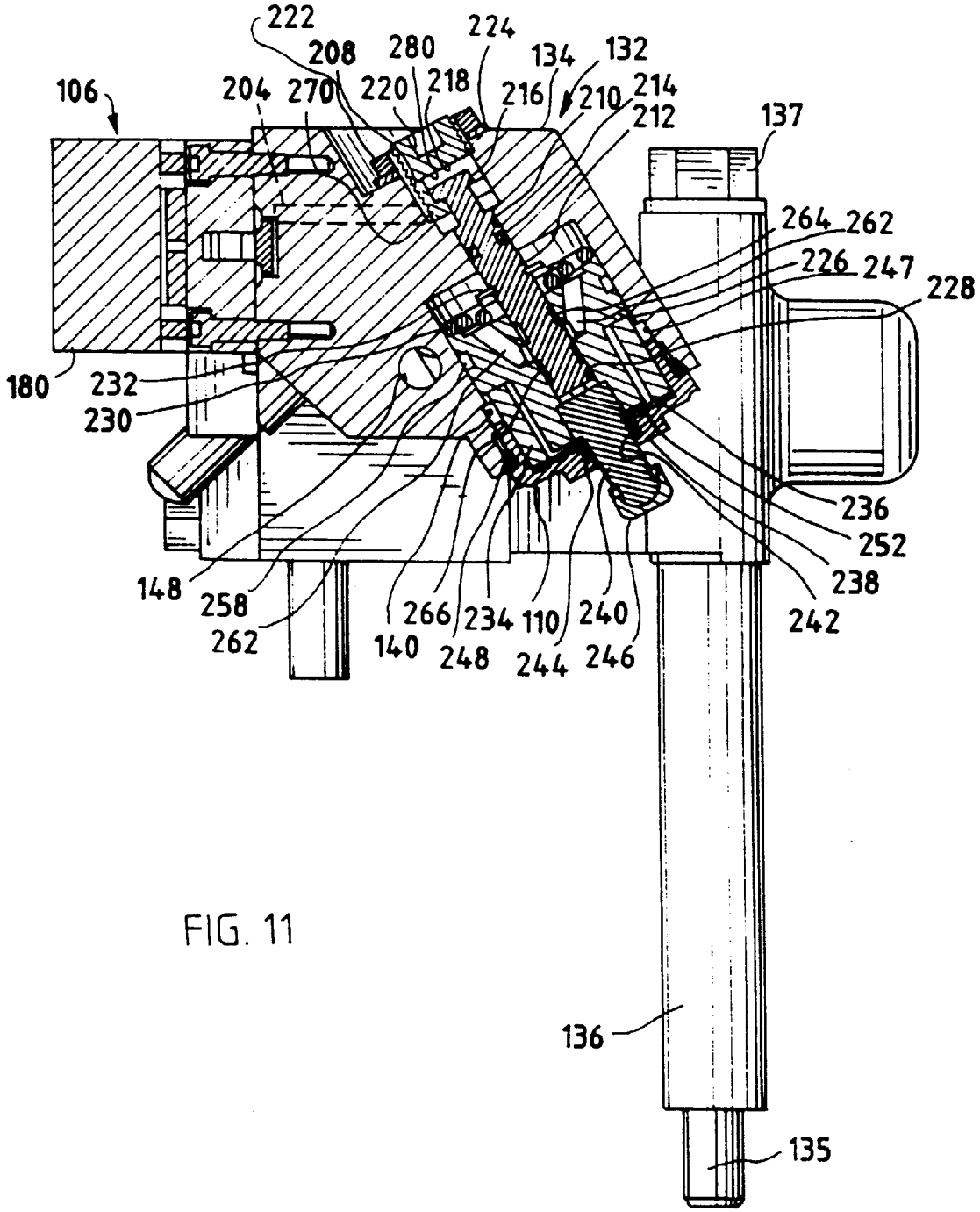

FIGS. 7–11 illustrate mechanical hardware for implementing the control of FIG. 6. Referring first to FIGS. 7, 8 and 11, a main body 132 includes a bridging portion 134. Threaded studs 135 extend through the main body 132 and spacers 136 into the head 41 and nuts 137 are threaded onto the studs 135. In addition, four bolts 138 extend through the main body 132 into the head 41. The bolts 138 replace rocker arm shaft hold down bolts and not only serve to secure the main body 132 to the head 41, but also extend through and hold a rocker arm shaft 139 in position.

Two actuator receiving bores 140 (only one of which is shown) are formed in the bridging portion 134. The servo-actuator 110 is received within the actuator receiving bore 140 while the servo-actuator 112 (not shown in FIGS. 7–11) is received within the other receiving bore. Inasmuch as the actuators 110 and 112 are identical, only the actuator 110 will be described in greater detail hereinafter.

FIGS. 9–11 illustrate the servo-actuator 110 in greater detail. A passage 148 (also seen in FIG. 8) receives high pressure engine oil from the accumulator 100 (FIG. 8). The passage 148 is in fluid communication with passages 170, 172 leading to the actuator receiving bore 140 and a valve bore 174, respectively. A ball valve 176 is disposed within the valve bore 174. The solenoid control valve 106 is disposed adjacent the ball valve 176 and includes a solenoid winding shown schematically at 180, an armature 182 adjacent the solenoid winding 180 and in magnetic circuit therewith and a load adapter 184 secured to the armature 182 by a screw 186. The armature 182 is movable in a recess defined in part by the solenoid winding 180, an armature spacer 185 and a further spacer 187. The solenoid winding 180 is energizable by the ECM 72, as noted in greater detail hereinafter, to move the armature 182 and the load adapter 184 against the force exerted by a return spring illustrated schematically at 188 and disposed in a recess 189 located in a solenoid body 191.

The ball valve includes a rear seat 190 having a passage 192 therein in fluid communication with the passage 172 and a sealing surface 194. A front seat 196 is spaced from the rear seat 190 and includes a passage 198 leading to a sealing surface 200. A ball 202 resides in the passage 198 between the sealing surfaces 194 and 200. The passage 198 comprises a counterbore having a portion 201 which has been cross-cut by a keyway cutter to provide an oil flow passage to and from the ball area.

A passage 204 (seen in phantom in FIGS. 9 and 11) extends from a bore 206 (FIGS. 9 and 10) containing the front seat 196 to an upper portion 208 of the receiving bore 140. As seen in FIG. 11, the receiving bore 140 further includes an intermediate portion 210 which closely receives a master fluid control device in the form of a valve spool 212 having a seal 214 which seals against the walls of the intermediate portion 210. The seal 214 is commercially available and is of two-part construction including a carbon fiber loaded teflon ring backed up and pressure loaded by an O-ring. The valve spool 212 further includes an enlarged head 216 which resides within a recess 218 of a lash stop adjuster 220. The lash stop adjuster 220 includes external threads which are engaged by a threaded nut 222 which, together with a washer 224, are used to adjust the axial position of the lash stop adjuster 220. The washer 224 is a commercially available composite rubber and metal washer which not only loads the adjuster 220 to lock the adjustment, but also seals the top of the actuator 110 and prevents oil leakage past the nut 222.

Figure 12:
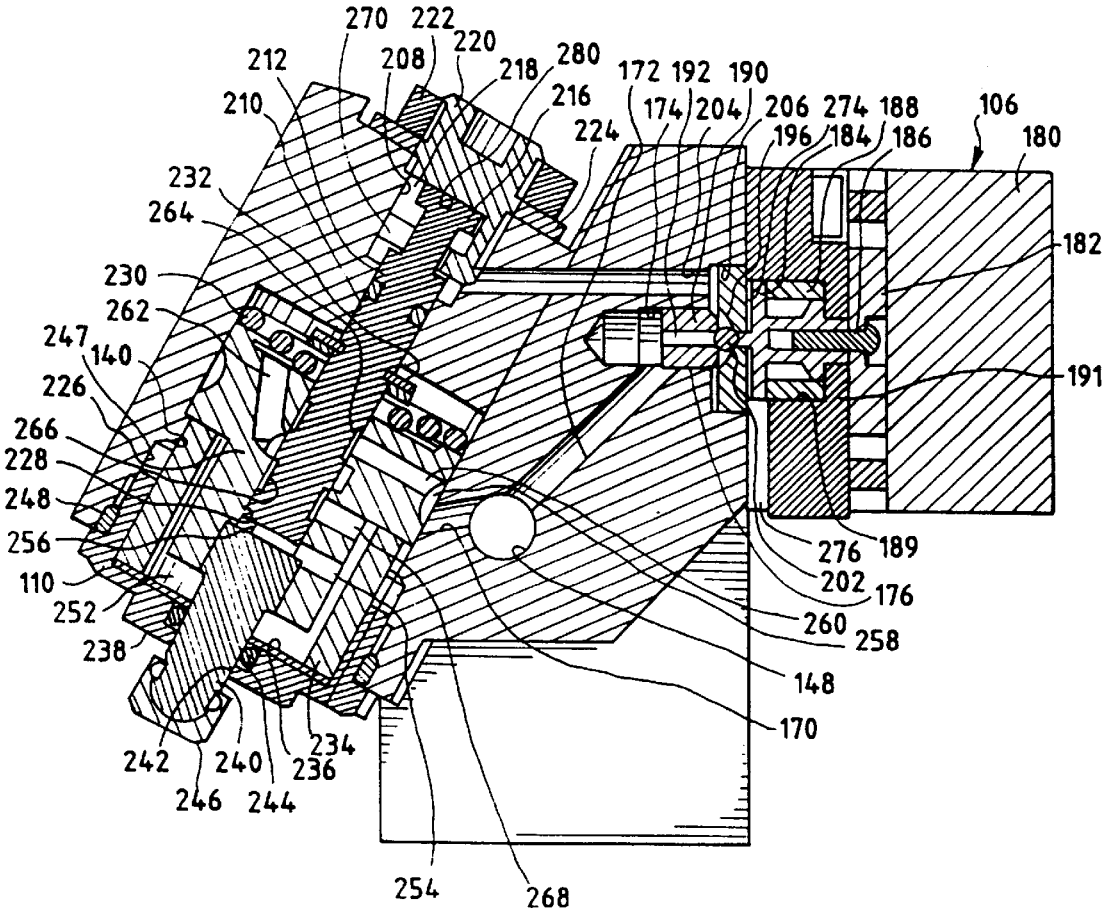
FIGS. 12 and 13 are composite sectional views illustrating the operation of the actuator of FIGS. 7–11.
Figure 13:
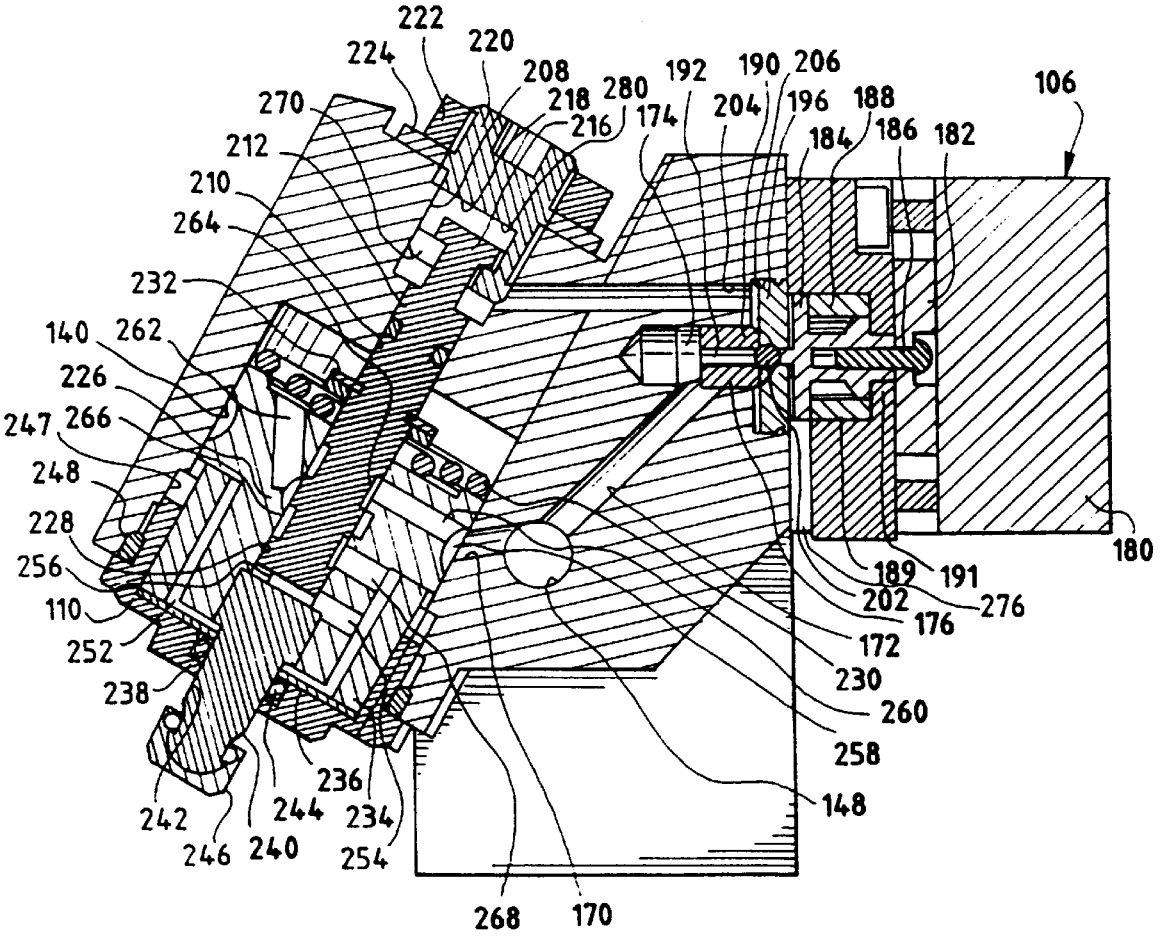

A slave fluid control device in the form of a piston 226 includes a central bore 228, seen in FIGS. 11–13, which receives a lower end of the spool 212. A spring 230 is placed in compression between a snap ring 232 carried in a groove in the spool 212 and an upper face of the piston 226. A return spring, shown schematically at 234, is placed in compression between a lower face of the piston 226 and a washer 236 placed in the bottom of a recess defined in part by an end cap 238. An actuator pin 240 is press-fitted within a lower portion of the central bore 228 so that the piston 226 and the actuator pin 240 move together. The actuator pin 240 extends outwardly through a bore 242 in the end cap 238 and an O-ring 244 prevents the escape of oil through the bore 242. In addition, a swivel foot 246 is pivotally secured to an end of the actuator pin 240.

The end cap 238 is threaded within a threaded portion 247 of the receiving bore 140 and an O-ring 248 provides a seal against leakage of oil.

As seen in FIG. 8, an oil return passage 250 extends between a lower recess portion 252, defined by the end cap 238, and the piston 226 and a pump inlet passage 160 which is in fluid communication with the inlet of the pump 88 (also see FIG. 6).

In addition to the foregoing, as seen in FIGS. 9, 12 and 13, an oil passage 254 is disposed between the lower recess portion 252 and a space 256 between the valve spool 212 and the actuator pin 240 to prevent hydraulic lock between these two components.

FIGS. 12 and 13 are composite sectional views which aid in understanding the operation of the actuator 110. When braking is commanded by an operator and the solenoid 74 is actuated by the ECM 72, oil is supplied to the inlet passage 160 (seen in FIGS. 6 and 8). As seen in FIG. 6, the oil flows at supply pressure past the check valve 84 into the pump 88. The pump 88 moves downwardly into contact with a fuel injector rocker arm. Reciprocation of the rocker arm causes the oil to be pressurized and delivered to the passage 148. The pressurized oil is thus delivered through the passage 172 and the passage 192 in the rear seat 190, as seen in FIG. 12.

When the ECM 72 commands opening of the exhaust valves 40 of a cylinder 34, the ECM 72 energizes the solenoid winding 180, causing the armature 182 and the load adapter 184 to move to the right as seen in FIG. 12 against the force of the return spring 188. Such movement permits the ball 202 to also move to the right into engagement with the sealing surface 200 (FIG. 10) under the influence of the pressurized oil in the passage 192, thereby permitting the pressurized oil to pass in the space between the ball 202 and the sealing surface 194. The pressurized oil flows through the passage 198 and the bore 206 into the passage 204 and the upper portion 208 of the receiving bore 140. The high fluid pressure on the top of the valve spool 212 causes it to move downwardly. The spring rate of the spring 230 is selected to be substantially higher than the spring rate of the return spring 234, and hence movement of the valve spool 212 downwardly tends to cause the piston 226 to also move downwardly. Such movement continues until the swivel foot takes up the lash and contacts the exhaust rocker arm 55. At this point, further travel of the piston 226 is temporarily prevented owing to the cylinder compression pressures on the exhaust valves 40. However, the high fluid pressure exerted on the top of the valve spool 212 is sufficient to continue moving the valve spool 212 downwardly against the force of the spring 230. Eventually, the relative movement between the valve spool 212 and the piston 226 causes an outer high pressure annulus 258 and a high pressure passage 260 (FIGS. 9, 12 and 13) in fluid communication with the passage 170 to be placed in fluid communication with a piston passage 262 via an inner high pressure annulus 264. Further, a low pressure annulus 266 of the spool 212 is taken out of fluid communication with the piston passage 262.

The high fluid pressure passing through the piston passage 262 acts on the large diameter of the piston 226 so that large forces are developed which cause the actuator pin 240 and the swivel foot 246 to overcome the resisting forces of the compression pressure and valve spring load exerted by valve springs 267 (FIG. 7). As a result, the exhaust valves 40 open and allow the cylinder to start blowing down pressure. During this time, the valve spool 212 travels with the piston 226 in a downward direction until the enlarged head 216 of the valve spool 212 contacts a lower portion 270 of the lash stop adjuster 220. At this point, further travel of the valve spool 212 in the downward direction is prevented while the piston 226 continues to move downwardly. As seen in FIG. 13, the inner high pressure annulus 264 is eventually covered by the piston 226 and the low pressure annulus 266 is uncovered. The low pressure annulus 266 is coupled by a passage 268 (FIGS. 9, 12 and 13) to the lower recess portion 252 which, as noted previously, is coupled by the oil return passage 250 to the pump inlet 160. Hence, at this time, the piston passage 262 and the upper face of the piston 226 are placed in fluid communication with low pressure oil. High pressure oil is vented from the cavity above the piston 226 and the exhaust valves 40 stop in the open position.

Thereafter, the piston 226 slowly oscillates between a first position, at which the inner high pressure annulus 264 is uncovered, and a second position, at which the low pressure annulus 266 is uncovered, to maintain the exhaust valves 40 in the open position as the cylinder 34 blows down. During the time that the exhaust valves 40 are in the open position, the ECM 72 provides drive current according to a predetermined schedule to provide good coil life and low power consumption.

When the exhaust valves 40 are to be closed, the ECM 72 terminates current flow in the solenoid winding 180. The return spring 188 then moves the load adapter 184 to the left as seen in FIGS. 12 and 13 so that the ball 202 is forced against the sealing surface 194 of the rear seat 190. The high pressure fluid above the valve spool 212 flows back through the passage 204, the bore 206, a gap 274 between the load adapter 184 and the front seat 196 and a passage 276 to the oil sump. In response to the venting of high pressure oil, the valve spool 212 is moved upwardly under the influence of the spring 230. As the valve spool 212 moves upwardly, the low pressure annulus 266 is uncovered and the high pressure annulus 258 is covered by the piston 226, thereby causing the high pressure oil above the piston 226 to escape through the passage 268. The return spring 234 and the exhaust valve springs 267 force the piston 226 upwardly and the exhaust valves 40 close. The closing velocity is controlled by the flow rate past the ball 202 into the passage 276. The valve spool 212 eventually seats against an upper surface 280 of the lash stop adjuster 220 and the piston 226 returns to the original position as a result of venting of oil through the inner high pressure annulus 264 and the low pressure annulus 266 such that the passage 268 is in fluid communication with the latter. As should be evident to one of ordinary skill in the art, the stopping position of the piston 226 is dependent upon the spring rates of the springs 230, 234. Oil remaining in the lower recess portion 252 is returned to the pump inlet 160 via the oil return passage 250.

The foregoing sequence of events is repeated each time the exhaust valves 40 are opened.

When the braking action of the engine is to be terminated, the ECM 72 closes the solenoid valve 74 and rapidly cycles the solenoid control valve 106 (and the other solenoid control valves) a predetermined number of cycles to vent off the stored high pressure oil to sump.

Figure 14:
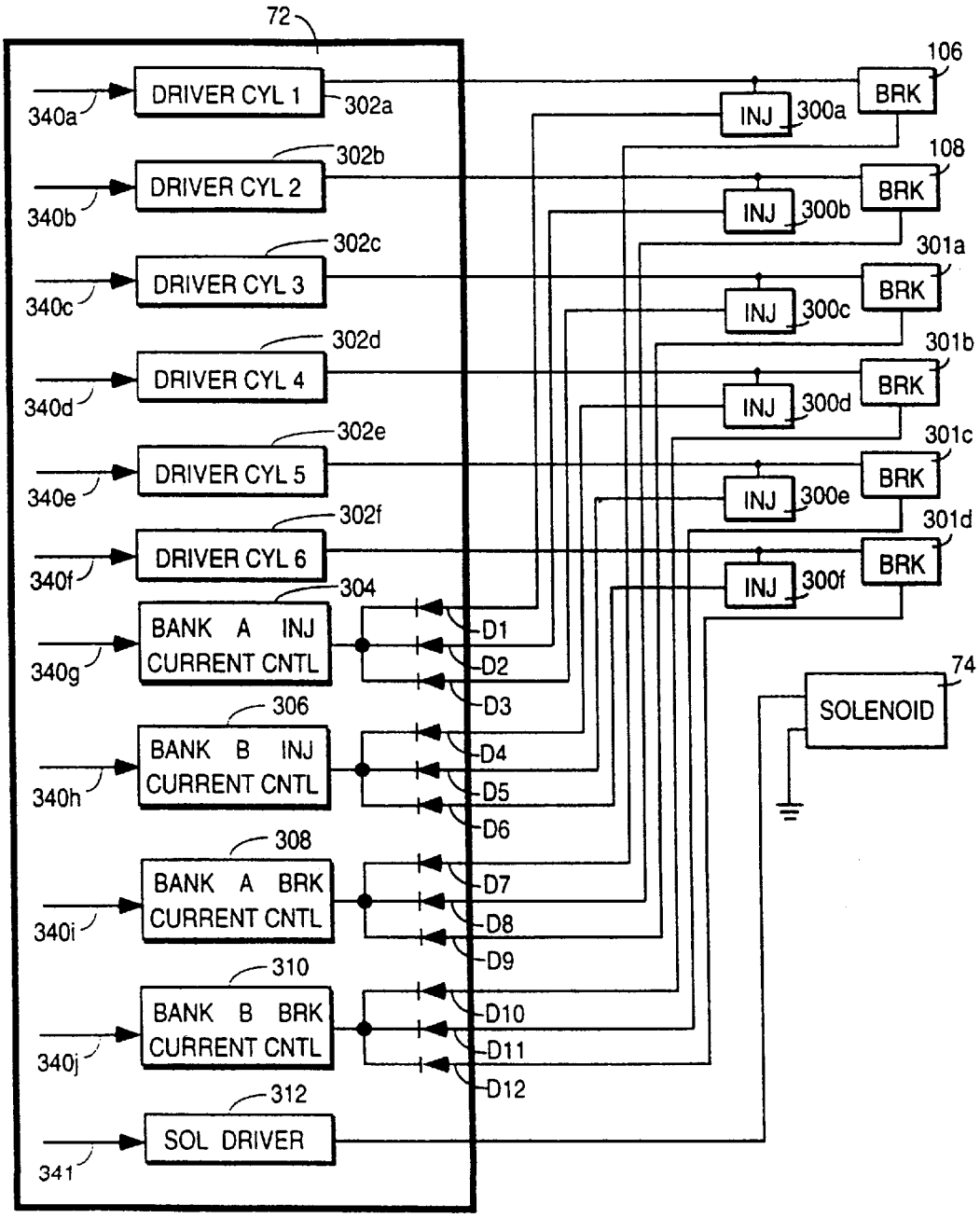
FIG. 14 is a block diagram illustrating output and driver circuits of an engine control module (ECM), a plurality of unit injectors and a plurality of braking controls according to the present invention.
Figure 15:
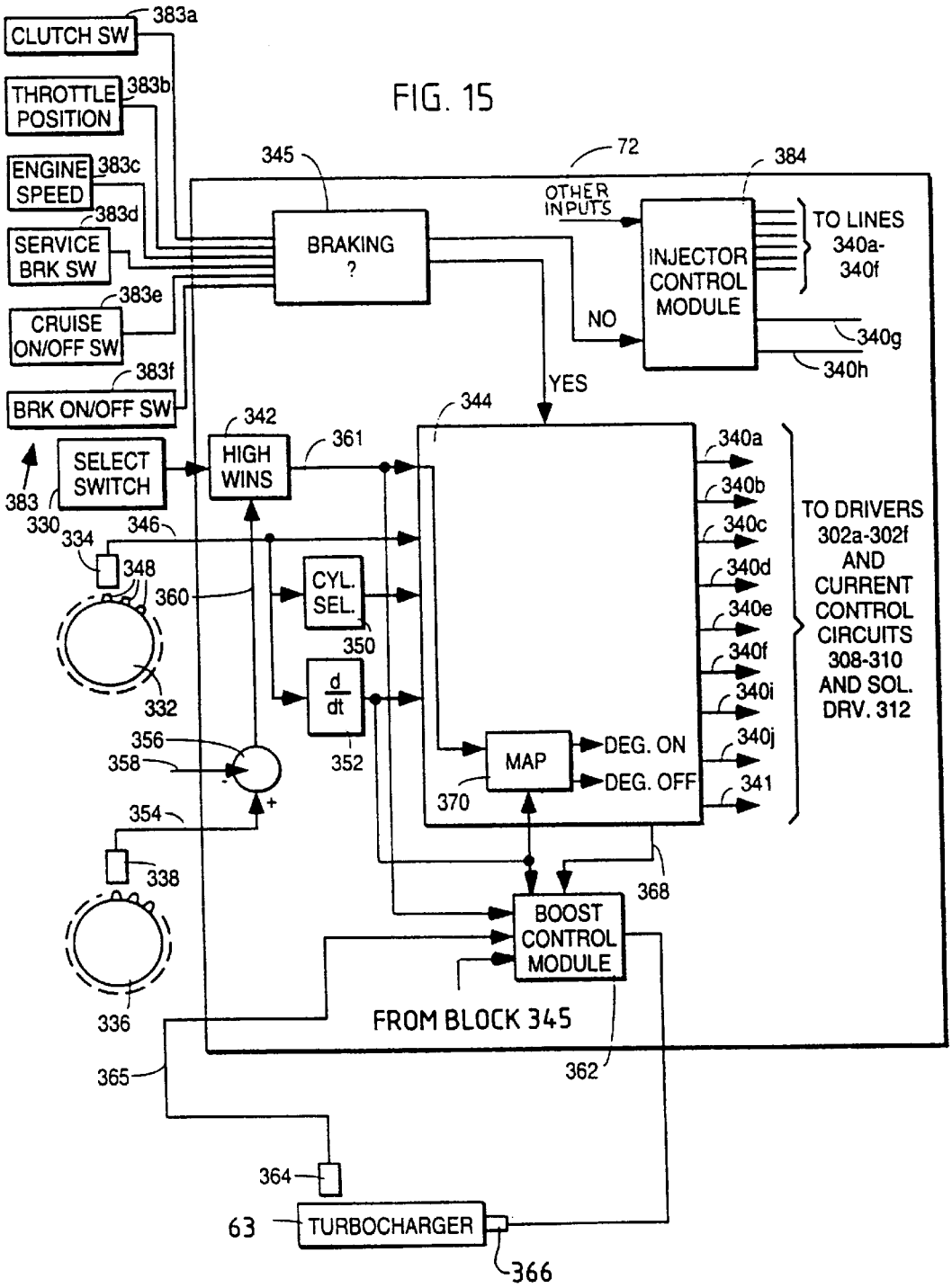
FIG. 15 comprises a block diagram of the balance of electrical hardware of the ECM.

FIGS. 14 and 15 illustrate the ECM 72 in greater detail as well as the wiring interconnections between the ECM 72 and a plurality of electronically controlled unit fuel injectors 300*a*–300*f*, which are individually operated to control the flow of fuel into the engine cylinders 34, and the solenoid control valves of the present invention, here illustrated as including the solenoid control valves 106, 108 and additional solenoid valves 301*a*–301*d*. Of course, the number of solenoid control valves would vary from that shown in FIG. 14 in dependence upon the number of cylinders to be used in engine braking. The ECM 72 includes six solenoid drivers 302*a*–302*f*, each of which is coupled to a first terminal of and associated with one of the injectors 300*a*–300*f* and one of the solenoid control valves 106, 108 and 301*a*–301*d*, respectively. Four current control circuits 304, 306, 308 and 310 are also included in the ECM 72. The current control circuit 304 is coupled by diodes D1–D3 to second terminals of the unit injectors 300*a*–300*c*, respectively, while the current control circuit 306 is coupled by diodes D4–D6 to second terminals of the unit injectors 300*d*–300*f*, respectively. In addition, the current control circuit 308 is coupled by diodes D7–D9 to second terminals of the brake control solenoids 106, 108 and 301*a*, respectively, whereas the current control circuit 310 is coupled by diodes D10–D12 to second terminals of the brake control solenoids 301*b*–301*d*, respectively. Further, a solenoid driver 312 is coupled to the solenoid 74.

In order to actuate any particular device 300*a*–300*f*, 106, 108 or 301*a*–301*d*, the ECM 72 need only actuate the appropriate driver 302*a*–302*f* and the appropriate current control circuit 304–310. Thus, for example, if the unit injector 300*a* is to be actuated, the driver 302*a* is operated as is the current control circuit 304 so that a current path is established therethrough. Similarly, if the solenoid control valve 301*d* is to be actuated, the driver 302*f* and the current control circuit 310 are operated to establish a current path through the control valve 301*d*. In addition, when one or more of the control valves 106, 108 or 301*a*–301*d* are to be actuated, the solenoid driver 312 is operated to deliver current to the solenoid 74, except when the solenoid control valve 106 is rapidly cycled as noted above.

It should be noted that when the ECM 72 is used to operate the fuel injectors 300*a*–300*f* alone and the brake control solenoids 106, 108 and 301*a*–301*d* are not included therewith, a pair of wires are connected between the ECM 72 and each injector 300*a*–300*f*. When the brake control solenoids 106, 108 and 301*a*–301*d* are added to provide engine braking capability, the only further wires that must be added are a jumper wire at each cylinder interconnecting the associated brake control solenoid and fuel injector and a return wire between the second terminal of each brake control solenoid and the ECM 72. The diodes D1–D12 permit multiplexing of the current control circuits 304–310; i.e., the current control circuits 304–310 determine whether an associated injector or brake control is operating. Also, the current versus time wave shapes for the injectors and/or solenoid control valves are controlled by these circuits.

FIG. 15 illustrates the balance of the ECM 72 in greater detail, and, in particular, circuits for commanding proper operation of the drivers 302*a*–302*f* and the current control circuits 304, 306, 308 and 310. The ECM 72 is responsive to the output of a select switch 330, a cam wheel 332 and a sensor 334 and a drive shaft gear 336 and a sensor 338. The ECM 72 develops drive signals on lines 340*a*–340*j* which are provided to the drivers 302*a*–302*f* and to the current control circuits 304, 306, 308 and 310, respectively, to properly energize the windings of the solenoid control valves 106, 108 and 301*a*–301*d*. In addition, a signal is developed on a line 341 which is supplied to the solenoid driver 312 to operate same. The select switch 330 may be manipulated by an operator to select a desired magnitude of braking, for example, in a range between zero and 100% braking. The output of the select switch 330 is passed to a high wins circuit 342 in the ECM 72, which in turn provides an output to a braking control module 344 that is selectively enabled by a block 345 when engine braking is to occur, as described in greater detail hereinafter. The braking control module 344 further receives an engine position signal developed on a line 346 by the cam wheel 332 and the sensor 334. The cam wheel is driven by the engine camshaft 46 (which is in turn driven by the crankshaft 42 as noted above) and includes a plurality of teeth 348 of magnetic material, three of which are shown in FIG. 15, and which pass in proximity to the sensor 334 as the cam wheel 332 rotates. The sensor 334, which may be a Hall effect device, develops a pulse type signal on the line 346 in response to passage of the teeth 348 past the sensor 334. The signal on the line 346 is also provided to a cylinder select circuit 350 and a differentiator 352. The differentiator 352 converts the position signal on the line 346 into an engine speed signal which, together with the cylinder select circuit 350 and the signal developed on the line 346, instruct the braking control module 344, when enabled, to provide control signals on the lines 340*a*–340*f* with the proper timing. Further, when the braking control module 344 is enabled, a signal is developed on the line 341 to activate the solenoid driver 312 and the solenoid 74.

The sensor 338 detects the passage of teeth on the gear 336 and develops a vehicle speed signal on a line 354 which is provided to a noninverting input of a summer 356. An inverting input of the summer 356 receives a commanded speed signal on a line 358 representing a desired or commanded speed for the vehicle. The signal on the line 358 may be developed by a cruise control or any other speed setting device. The resulting error signal developed by the summer 356 is provided to the high wins circuit 342 over a line 360. The high wins circuit 342 provides the signal developed by the select switch 330 or the error signal on the line 360 to the braking control module 344 as a signal %BRAKING on a line 361 in dependence upon which signal has the higher magnitude. If the error signal developed by the summer 356 is negative in sign and the signal developed by the select switch 330 is at a magnitude commanding no (or 0%) braking, the high wins circuit 342 instructs the braking control module 344 to terminate engine braking.

If desired, the high wins circuit 342 may be omitted, and the signal on the line 361 may be supplied by the select switch 330, the summer 356 or the cruise control on the line 358.

A boost control module 362 is responsive to the signal %BRAKING on the line 361 and is further responsive to a signal, called BOOST, developed by a sensor 364 on a line 365 which detects the magnitude of engine intake manifold air pressure. In the preferred embodiment, the turbocharger 63 has a variable nozzle geometry which can be controlled by a vane actuator 366 to allow boost level to be controlled by the boost control module 362. The module 362 may receive a limiter signal on a line 368 developed by the braking control module 344 which allows for as much boost as the turbocharger 366 can develop under the current engine conditions but prevents the boost control module from increasing boost to a level which would cause damage to engine components.

Figure 16:
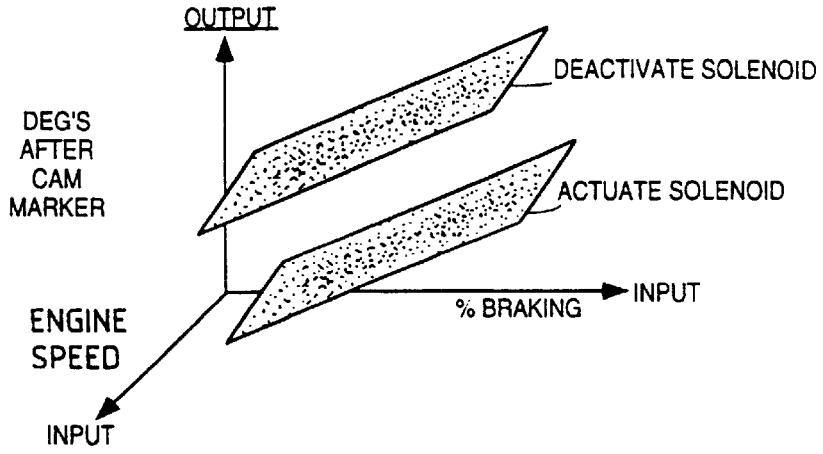
FIG. 16 comprises a three-dimensional representation of a map relating solenoid control valve actuation and deactuation timing as a function of desired braking magnitude and engine speed.
Figure 17:
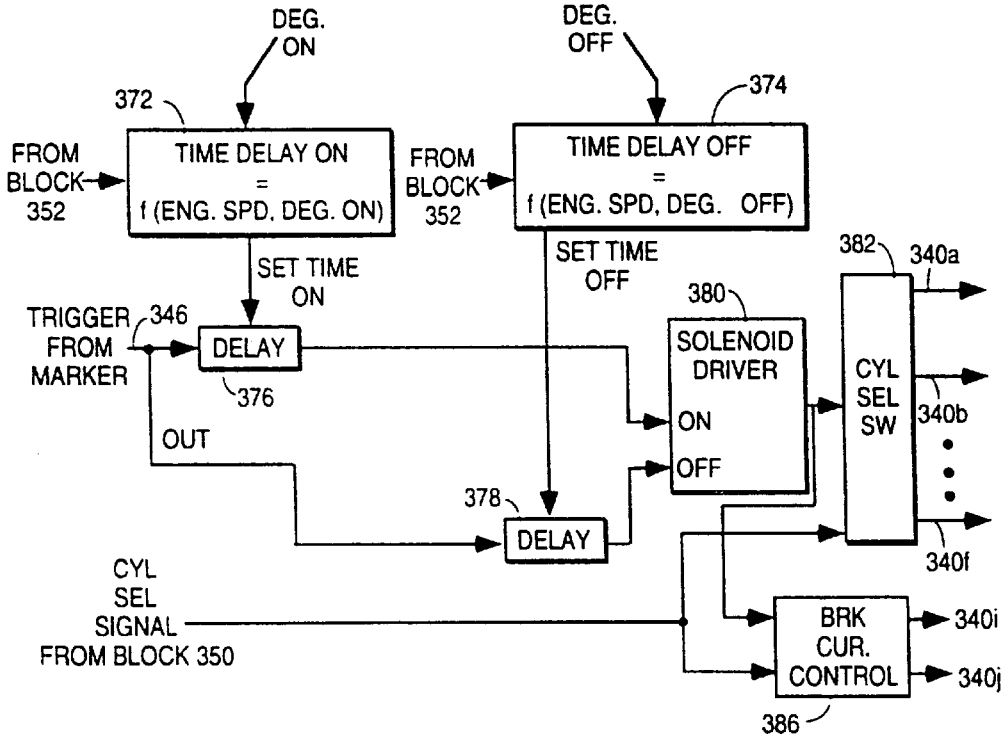
FIG. 17 comprises a block diagram of software executed by the ECM to implement the braking control module of FIG. 15.

The braking control module includes a lookup table or map 370 which is addressed by the signal developed at the output of the differentiator 352 and the signal on the line 361 and provides output signals DEG. ON and DEG. OFF to the control of FIG. 17. FIG. 16 illustrates in three dimensional form the contents of the map 370 including the output signals DEG. ON and DEG. OFF as a function of the addressing signals ENGINE SPEED and %BRAKING. The signals DEG. ON and DEG. OFF indicate the timing of solenoid control valve actuation and deactuation, respectively, in degrees after a cam marker signal is produced by the cam wheel 332 and the sensor 334. Specifically, the cam wheel 332 includes twenty-four teeth, twenty-one of which are identical to one another and each of which occupies 80% of a tooth pitch with a 20% gap. Two of the remaining three teeth are adjacent to one another (i.e., consecutive) while the third is spaced therefrom and each occupies 50% of a tooth pitch with a 50% gap. The ECM 72 detects these non-uniformities to determine when cylinder number 1 of the engine 30 reaches TDC between compression and power strokes as well as engine rotation direction.

The signal DEG ON is provided to a computational block 372 which is responsive to the engine speed signal developed by the block 352 of FIG. 15 and which develops a signal representing the time after a reference point or marker on the cam wheel 332 passes the sensor 334 at which a signal on one of the lines 340*a*–340*f* is to be switched to a high state. In like fashion, a computational block 374 is responsive to the engine speed signal developed by the block 352 and develops a signal representing the time after the reference point passes the sensor 334 at which the signal on the same line 340*a*–340*f* is to be switched to an off state. The signals from the blocks 372, 374 are supplied to delay blocks 376, 378, respectively, which develop on and off signals for a solenoid driver block 380 in dependence upon the marker developed by the cam wheel 332 and the sensor 334 and in dependence upon the particular cylinder which is to be employed next in braking. The signal developed by the delay block 376 comprises a narrow pulse having a leading edge which causes the solenoid driver block 380 to develop an output signal having a transition from a low state to a high state whereas the timer block 378 develops a narrow pulse having a leading edge which causes the output signal developed by the solenoid driver circuit 380 to switch from a high state to a low state. The signal developed by solenoid driver circuit 380 is routed to the appropriate output line 340*a*–340*f* by a cylinder select switch 382 which is responsive to the cylinder select signal developed by the block 350 of FIG. 15.

The braking control module 344 is enabled by the block 345 in dependence upon certain sensed conditions as detected by sensors/switches 383. The sensors/switches include a clutch switch 383*a* which detects when a clutch of the vehicle is engaged by an operator (i.e., when the vehicle wheels are disengaged from the vehicle engine), a throttle position switch 383*b* which detects when a throttle pedal is depressed, an engine speed sensor 383*c* which detects the speed of the engine, a service brake switch 383*d* which develops a signal representing whether the service brake pedal of the vehicle is depressed, a cruise control on/off switch 383*e* and a brake on/off switch 383*f*. If desired, the output of the circuit 352 may be supplied in lieu of the signal developed by the sensor 383*c*, in which case the sensor 383*c* may be omitted. According to a preferred embodiment of the present invention, the braking control module 344 is enabled when the on/off switch 383*f* is on, the engine speed is above a particular level, for example 950 rpm, the driver's foot is off the throttle and clutch and the cruise control is off. The braking control module 344 is also enabled when the on/off switch 383*f* is on, engine speed is above the certain level, the driver's foot is off the throttle and clutch, the cruise control is on and the driver depresses the service brake. Under the second set of conditions, and also in accordance with the preferred embodiment, a "coast" mode may be employed wherein engine braking is engaged only while the driver presses the service brake, in which case the braking control module 344 is disabled when the driver's foot is removed from the service brake. According to an optional "latched" mode of operation operable under the second set of conditions as noted above, the braking control module 344 is enabled by the block 345 once the driver presses the service brake and remains enabled until another input, such as depressing the throttle or selecting 0% braking by means of the switch 330, is supplied.

The block 345 enables an injector control module 384 when the braking control module 344 is disabled, and vice versa. The injector control module 384 supplies signals over the lines 340*a*–340*f* as well as over lines 340*g* and 340*h* to the current control circuits 304 and 306 of FIG. 14 so that fuel injection is accomplished.

Referring again to FIG. 17, the signal developed by the solenoid driver circuit 380 is also provided to a current control logic block 386 which in turn supplies signals on lines 340*i*, 340*j* of appropriate waveshape and synchronization with the signals on the lines 340*a*–340*f* to the blocks 308 and 310 of FIG. 14. Programming for effecting this operation is completely within the abilities of one of ordinary skill in the art and will not be described in detail herein.

Figure 18:
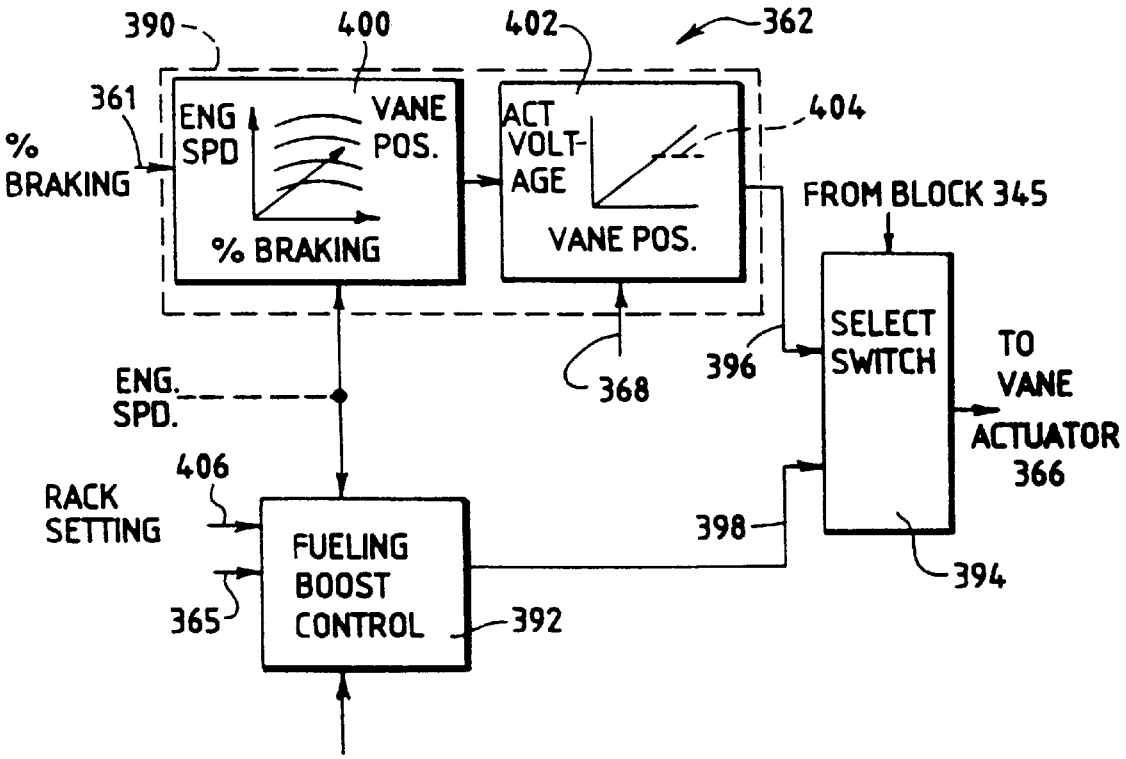
FIG. 18 is a block diagram illustrating the boost control module of FIG. 15 in greater detail.

FIG. 18 illustrates the boost control module 362 in greater detail. The module 362 includes a braking boost control 390 and a fueling boost control 392 which are coupled to a select switch 394. The select switch 394 is responsive to one or both of the signals developed by the block 345 of FIG. 15 to pass either a signal developed by the braking boost control 390 on a line 396 or a signal developed on a line 398 by the fueling boost control 392 to the vane actuator 366 at FIG. 15 in dependence upon whether braking or fueling (i.e., normal) operation is commanded.

The braking boost control 390 includes a look-up table or map 400 which develops a vane position signal in response to addressing thereof by the %BRAKING signal on the line 361 and the signal representing engine speed as developed by the differentiator 354 of FIG. 15. The vane position signal is passed to a further look-up table 402 which develops an actuator voltage signal as a function of the vane position signal developed by the look-up table 400. The actuator voltage signal may be limited at vane position signal magnitudes in excess of a given level, as shown by the dotted lines 404. The limit may be set at a constant magnitude or may be variably and/or adaptively established by the signal on the line 368. The look-up table 402 supplies the signal over the line 396 to the select switch 394.

If desired, the open loop control strategy implemented by the braking boost control 390 shown in FIG. 18 may be replaced by a closed loop strategy wherein the vane position signal developed by the look-up table 400 is summed with a signal representing actual vane position to develop an error signal which is used as the input to the look-up table 402.

The fueling boost control circuit 392 is responsive to a number of parameters, including engine speed, as developed by the differentiator 352 of FIG. 15, the signal on the line 365 and a signal on a line 406 representing commanded fuel delivery (i.e., rack) limits. The fueling boost control 392 may alternatively be responsive to fewer than all of such parameters, or may be responsive to additional parameters, such as exhaust gas recovery (EGR) valve position, or the like. Further or alternatively, engine boost magnitude may be sensed and a signal representative thereof may be used in a closed-loop boost control, if desired. Inasmuch as the design of the fueling boost control 392 is conventional and well within the capabilities of one of ordinary skill in the art, it will not be described further in detail herein.

Figure 20:
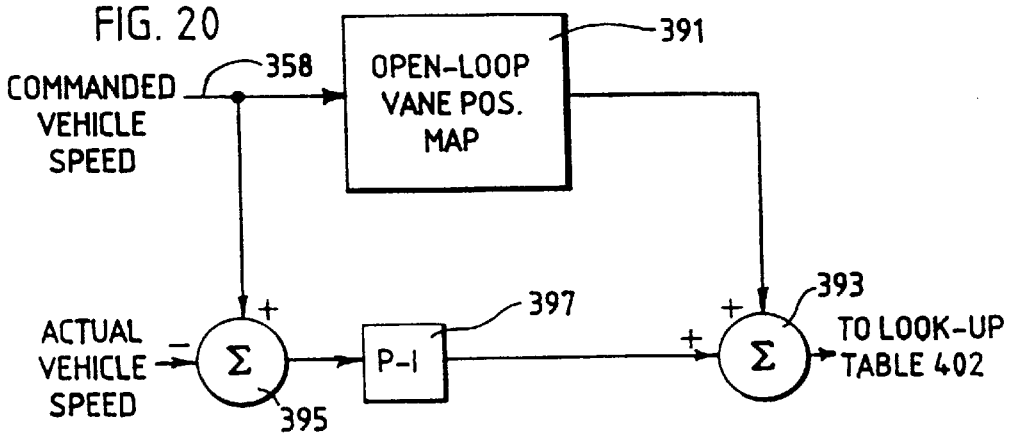
FIG. 20 is a block diagram illustrating modifications to the flowchart of FIG. 18 to implement an alternative embodiment of the present invention.

It should be noted that the values stored in the map 370 and the look-up table 400 are selected in dependence upon a desired braking control strategy to be implemented. For example, the stored values may be implemented to establish: (a) fixed timing points for engine exhaust valve opening events for either fixed or controllably variable exhaust valve open durations in combination with controllably variable vane positioning of the turbocharger; (b) controllably variable timing of engine exhaust valve opening events with fixed or controllably variable exhaust valve open durations in combination with a fixed vane positioning; or (c) controllably variable timing of engine exhaust valve opening events for fixed or controllably variable exhaust valve opening durations in combination with a controllably variable turbocharger vane position. During operation under control strategy (c), valve timing and vane position may be continuously and infinitely variable, or either or both parameters can be varied in discrete steps as a function of desired braking or commanded vehicle speed. In the latter case, the signal provided to the look-up table 402 would be developed by the control of FIG. 20. With specific reference to such Fig., a signal representing commanded vehicle speed, as developed by an on the line 358 of FIG. 15, is supplied to a look-up table or map 391 which stores signals representing commanded vane position as a function of commanded vehicle speed. The signal developed by the map 391 is delivered to a first, noninverting input of a summer 393. The commanded vehicle speed signal on the line 358 is also supplied to a noninverting input of a further summer 395 having an inverting input that receives a signal representing actual vehicle speed as developed by any suitable means, such as the vehicle speedometer. The summer 395 develops a vehicle speed error signal which is processed by a proportional-integral (P-I) controller 397 and delivered to a further noninverting input of the summer 393 where such a signal is summed with the signal developed by the map 391 to obtain an input for the look-up table 402. In this case, the table 402 is stored with appropriate values to develop the signal on the line 396 of FIG. 18.

Figure 19:
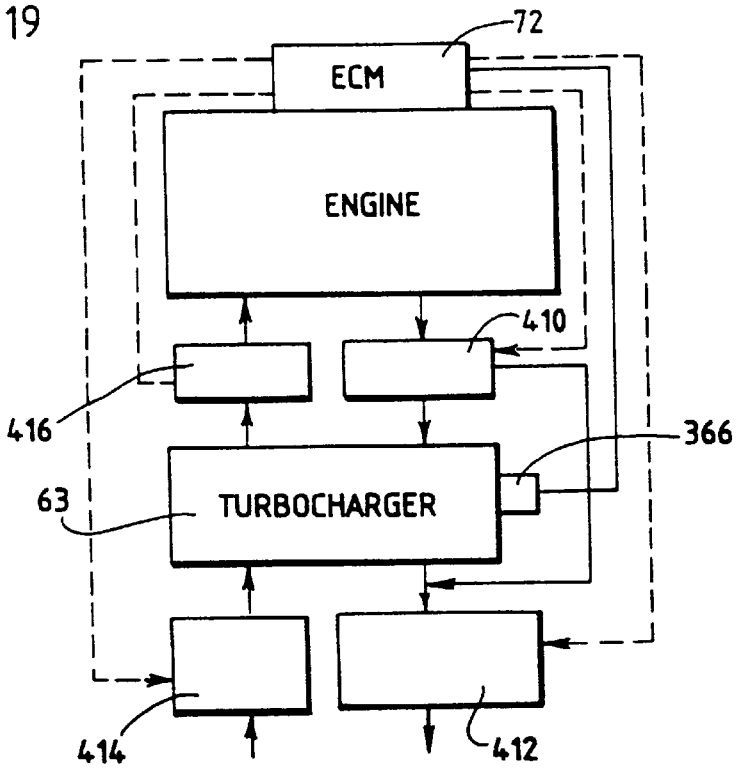
FIG. 19 is a block diagram similar to FIG. 1 illustrating alternative embodiments of the present invention.

FIG. 19 illustrates alternative embodiments of the present invention wherein one or more optional devices are added to assist in controlling engine braking. On the turbine (i.e., exhaust) side of the turbocharger 63, a wastegate 410 may be employed between the engine exhaust manifold and the turbocharger exhaust gas inlet to divert a variable quantity of exhaust gases around the turbocharger turbine in response to commands issued by the ECM 72. Also or alternatively, a flapper valve 412 may be employed between the turbocharger exhaust gas outlet and the vehicle exhaust system to provide a variable restriction under control of the ECM 72 to exhaust gases.

On the air intake or compressor side of the turbocharger 63, a flow control valve 414 may be included and operated by the ECM 72 to provide a controlled restriction to air entering the turbocharger 63. Still further, a pressure control valve 416 may be provided between the air outlet of the turbocharger and the intake manifold of the engine and which is effective to maintain the pressure of air in the intake manifold at a selected controllable level in response to commands from the ECM 72.

As noted above, any combination of elements 410, 412, 414 or 416 may be employed. Further, any or all of those elements 410–416 that are employed may alternatively be controlled by a different device and/or may be maintained at a fixed setting during braking. Also, the turbocharger 63 may be maintained at a fixed vane position during braking or may be replaced by a turbocharger not having a variable geometry. In the last case, control over intake manifold air pressure would be effected by having at least one of the elements 410–416 responsive to commands issued by a controller, such as the ECM 72.

It should be noted that if one or more of the elements 410–416 is used and is (are) to be responsive to controller commands, one or more braking control modules similar to the braking control module 390 of FIG. 24 would be utilized to control such element(s). In this case, a look-up table like the look-up table 400 would develop a commanded control element position or operation signal as a function of engine speed and the signal %BRAKING on the line 361. The module would further include a look-up table like the look-up table 402 which develops an actuator command signal for controlling the element 410-416 as a function of the commanded control element position or operation signal. Alternatively, the signal for the look-up table corresponding to the table 402 would be derived from the control of FIG. 20. Again, the values stored in such look-up tables are selected in coordination with the selection of values stored in the map 370 of FIG. 15 as described above.

It should be noted that any or all of the elements represented in FIGS. 15, 17, 18 and 20 may be implemented by software, hardware or by a combination of the two.

The foregoing system permits a wide degree of flexibility in setting the timing and duration of exhaust valve opening and the intake manifold and/or exhaust manifold pressure. This flexibility results in an improvement in the maximum braking achievable within the structural limits of the engine. Also, braking smoothness is improved inasmuch as all of the cylinders of the engine can be utilized to provide braking. Still further, smooth modulation of braking power from zero to maximum can be achieved owing to the ability to precisely control timing and duration of exhaust valve opening at all engine speeds and intake and/or exhaust manifold pressure. Still further, in conjunction with a cruise control as noted above, smooth speed control during downhill conditions can be achieved.

Moreover, the use of a pressure-limited bulk modulus accumulator permits setting of a maximum accumulator pressure which prevents damage to engine components. Specifically, with the accumulator maximum pressure properly set, the maximum force applied to the exhaust valves can never exceed a preset limit regardless of the time of the valve opening signal. If the valve opening signal is developed at a time when cylinder pressures are extremely high, the exhaust valves simply will not open rather than causing a structural failure of the system.

Also, by recycling oil back to the pump inlet passage 160 from the actuator 110 during braking, demands placed on an oil pump of the engine are minimized once braking operation is implemented.

It should be noted that the integration of a cruise control and/or a turbocharger control in the circuitry of FIG. 15 is optional. In fact, the circuitry of FIG. 15 may be modified in a manner evident to one of ordinary skill in the art to implement use of a traction control therewith whereby braking horsepower is modulated to prevent wheel slip, if desired.

The integration of the injector and braking wiring and connections to the ECM permits multiple use of drivers, control logic and wiring and thus involves little additional cost to achieve a robust and precise brake control system.

As the foregoing discussion demonstrates, engine braking can be accomplished by opening the exhaust valves in some or all of the engine cylinders at a point just prior to TDC. As an alternative, the exhaust valve(s) associated with each cylinder may also be opened at a point near bottom dead center (BDC). This event, which is added by suitable programming of the ECM 72 in a manner evident to one of ordinary skill in the art, permits a pressure spike arising in the exhaust manifold of the engine to boost the pressure in the cylinder just prior to compression. This increased cylinder pressure causes a larger braking force to be developed owing to the increased retarding effect on the engine crankshaft.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. A brake control for an engine having intake and exhaust manifolds and operable in a braking mode during which an engine exhaust valve is opened to allow compressed gases in an associated combustion chamber to escape during a compression stroke and thereby brake a load driven by the engine, comprising:

means for controlling at least one of intake and exhaust manifold pressures, the controlling means including a pressure controller operated by an electronic control module to controllably vary at least one of the intake and the exhaust manifold pressures;

an exhaust valve actuator for opening the exhaust valve; and means operable while the engine is in the braking mode and responsive to a command representing a desired load condition for operating the controlling means and the exhaust valve actuator such that the exhaust valve is opened at a selectable timing and for a selectable duration.

2. The brake control of claim 1, wherein the controlling means comprises a variable geometry turbocharger coupled to the intake manifold.

3. The brake control of claim 1, wherein the controlling means comprises a turbocharger coupled to the intake manifold and a controllable wastegate bypassing the turbocharger.

4. The brake control of claim 1, wherein the controlling means comprises a turbocharger and a pressure control valve coupled to the intake manifold.

5. The brake control of claim 1, wherein the controlling means includes a turbocharger having a boost outlet coupled to the intake manifold and an exhaust gas inlet and wherein the controlling means further includes means coupled between an engine exhaust manifold and the exhaust gas inlet for controllably varying turbocharger speed.

* * * * *